US010810918B2

(12) United States Patent
Hwang

(10) Patent No.: US 10,810,918 B2
(45) Date of Patent: Oct. 20, 2020

(54) VIDEO DISPLAY DEVICE CAPABLE OF COMPENSATING FOR DISPLAY DEFECTS

(75) Inventor: Jong Hee Hwang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 12/155,396

(22) Filed: Jun. 3, 2008

(65) Prior Publication Data

US 2008/0309602 A1 Dec. 18, 2008

(30) Foreign Application Priority Data

Jun. 14, 2007 (KR) ..... 10-2007-0058492
Nov. 1, 2007 (KR) ..... 10-2007-0111217
(Continued)

(51) Int. Cl.
*G09G 3/00* (2006.01)
*G09G 3/20* (2006.01)

(52) U.S. Cl.
CPC ..... *G09G 3/006* (2013.01); *G09G 3/2055* (2013.01); *G09G 2330/10* (2013.01)

(58) Field of Classification Search
CPC ..... G09G 2320/0285; G09G 3/006; G09G 3/2055; G09G 2330/10
(Continued)

(56) References Cited

U.S. PATENT DOCUMENTS 5,793,344 A * 8/1998 Koyama ..... 345/87
6,097,462 A 8/2000 Koe
(Continued)

FOREIGN PATENT DOCUMENTS

JP 2001-75523 A 3/2001
JP 2006-30362 A 2/2006
(Continued)

OTHER PUBLICATIONS

Dictionary.com, "adjacent," in Dictionary.com Unabridged. Source location: Random House, Inc. http://dictionary.reference.com/browse/adjacent, Nov. 18, 2011, p. 1.*
(Continued)

*Primary Examiner* — Stephen G Sherman
(74) *Attorney, Agent, or Firm* — Morgan, Lewis & Bockius LLP

(57) ABSTRACT

A video display device capable of compensating for display defects, comprising: liquid crystal panel for displaying an image through a pixel matrix; a data driver for outputting data to data lines of the liquid crystal display panel; a gate driver for driving the gate lines of the liquid crystal display panel; a timing controller for receiving compensated data, uncompensated data and synchronizing signals to output a gate control signal to the gate driver and to output both resultant data and a data control signal to the data driver; and a memory for storing information on point defect information on the liquid crystal display panel, and at least one of horizontal and vertical line defects of the liquid crystal display panel of the liquid crystal display panel; and a data compensation circuit for receiving display data and synchronizing signals, and outputting compensated data to the timing controller based on the information in the memory and uncompensated data to the timing controller, wherein the data compensation circuit includes a vertical line compensator for compensating a vertical line defect of the liquid crystal display panel, a horizontal line compensator for compensating a horizontal line defect of the liquid crystal display panel, and a multiplexer for selecting an output from one of the vertical line compensator and the horizontal line compensator in accordance with whether a defect is a vertical line defect or a horizontal line defect.

20 Claims, 20 Drawing Sheets

(30) Foreign Application Priority Data

Feb. 19, 2008 (KR) ..... 10-2008-0014842
Apr. 2, 2008 (KR) ..... 10-2008-0030827

(58) Field of Classification Search
USPC ..... 345/89, 98–100, 103, 690; 349/33
See application file for complete search history.

(56) References Cited

U.S. PATENT DOCUMENTS

| | | | | |
|---|---|---|---|---|
| 6,278,427 | B1 | 8/2001 | Matsumoto et al. | |
| 7,499,061 | B2 * | 3/2009 | Hiraki et al. | 345/648 |
| 2002/0067326 | A1 * | 6/2002 | Aoki | G09G 3/3648 345/89 |
| 2006/0012606 | A1 * | 1/2006 | Hiraki et al. | 345/590 |
| 2006/0061593 | A1 * | 3/2006 | Miura et al. | 345/612 |
| 2006/0109231 | A1 * | 5/2006 | Koyama | 345/98 |
| 2007/0085790 | A1 * | 4/2007 | Chung et al. | 345/88 |
| 2007/0091042 | A1 * | 4/2007 | Chung et al. | 345/88 |
| 2007/0097050 | A1 * | 5/2007 | Chae et al. | 345/89 |
| 2008/0238936 | A1 * | 10/2008 | Kim | G09G 3/3648 345/618 |

FOREIGN PATENT DOCUMENTS

| | | | |
|---|---|---|---|
| JP | 2006-119585 | A | 5/2006 |
| JP | 2007-114733 | A | 5/2007 |
| JP | 2007-122009 | A | 5/2007 |
| TW | 480358 | | 3/2002 |
| TW | 200717403 | | 5/2007 |

OTHER PUBLICATIONS

Taiwanese Office Action and English translation dated Nov. 26, 2012, issued in a corresponding Taiwanese patent application.

* cited by examiner

VIDEO DISPLAY DEVICE CAPABLE OF COMPENSATING FOR DISPLAY DEFECTS

This application claims the benefit of the Korean Patent Application No. P2007-058492 filed on Jun. 14, 2007, Korean Patent Application No. P2007-111217 filed on Nov. 1, 2007, Korean Patent Application No. P2008-014842 filed Feb. 19, 2008 and Korean Patent Application No. P2008-030827 filed Mar. 30, 2008, which are all hereby incorporated by reference as if fully set forth herein.

BACKGROUND OF THE INVENTION

Field of the Invention

Embodiments of the invention relate to a display device, and more particularly, to a video display device capable of compensating for display defects. Although embodiments of the invention are suitable for a wide scope of applications, they are particularly suitable for using compensation data to achieve an enhancement in display quality.

Discussion of the Related Art

Recently, for video display devices, flat display devices, such as liquid crystal display (LCD), plasma display panel (PDP), and organic light emitting diode (OLED) display device, have typically been used. Such video display devices are subjected to an inspection process during the manufacturing to inspect for display defects that may exist on the display panel. When the display panel is detected as having display defects, a repair process is carried out to repair defective portions of the display panel. However, there may be display defects that cannot be repaired by the repair process.

Display defects are mainly caused by a deviation in the amount of light exposure from overlapped light exposure in a multi-exposure operation of exposure equipment used in a thin film pattern formation process or from aberrations of the multi-lenses used in the exposure equipment. More specifically, a deviation in the amount of light exposure causes a variation in the width of thin film patterns, thereby resulting in deviation in parasitic capacity among thin film transistors, deviation in height among column spacers for maintaining a desired cell gap, and/or a deviation in parasitic capacity among signal lines. Such deviations cause brightness aberrations appearing as display defects. Such display defects incurred by deviations in the amount of light exposure are displayed on the display panel as vertical lines or horizontal lines in accordance with the scanning direction of the exposure equipment. However, it is difficult, if not impossible, to eliminate all such vertical or horizontal-line-shaped display defects through improvements in the processing techniques.

Display defects can also be displayed in the form of point defects at defective pixels containing foreign matter. Although such defective pixels are subjected to a repair process, they can still have point defects in the repaired state. For example, when a defective pixel is repaired in the form of a dark pixel by a repair process, the dark pixel will be displayed in the form of a black point defect in a white image. Also, when a repair process is performed such that the pixel repaired in the form of a dark pixel is linked to a neighboring normal pixel, the linked pixels may be displayed as point defects due to a shortage of data charge amount because data supplied to the normal pixel must also be distributed evenly to the repaired pixel.

To this end, methods for compensating for display defects through circuitry have recently been proposed to solve display defects that cannot be eliminated through a physical repair process. However, the related art circuit-based compensation methods have problems in using a horizontal line data compensation circuit to address a display device having vertical line display defects, and, vice versa, to apply a vertical line data compensation circuit to a display device having horizontal line display defects. This is because the horizontal and vertical display defects, which are caused by a deviation in light exposure amount, are different from each other in terms of brightness distribution and defect position information.

Related art circuit-based compensation methods also can not achieve adaptive addition and subtraction of a compensation value in accordance with the brightness of an associated defect region. For example, there is a problem in that it is difficult to quantify and systematize compensation values for defect regions by using a method, in which a defect region is compensated for brightness such that the defect region becomes brighter than normal regions around the defect region, on the assumption that the defect region is dark, or a method, in which, when the defect region is bright, the normal regions are compensated for brightness such that the normal regions become brighter. Therefore, related art video display devices require a data compensation circuit capable of achieving adaptive addition and subtraction of a compensation value in accordance with the position of an associated defect region, while being applicable to both the video display device having horizontal line display defects and the video display device having vertical line display defects, irrespective of such kinds of display defects. Further, a data compensation circuit having a simple configuration is desired to reduce costs.

SUMMARY OF THE INVENTION

Accordingly, embodiments of the invention are directed to a video display device capable of compensating for display defects that substantially obviates one or more problems due to limitations and disadvantages of the related art.

An object of embodiments of the invention is to provide a video display device capable of compensating for various display defects using compensation data and having a simple circuit configuration.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

It is to be understood that both the foregoing general description and the following detailed description of embodiments of the invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE PREFERRED EMBODIMENTS

Reference will now be made in detail to the preferred embodiments of the invention, examples of which are illustrated in the accompanying drawings. Wherever possible, the same reference numbers will be used throughout the drawings to refer to the same or like parts.

Figure 1:
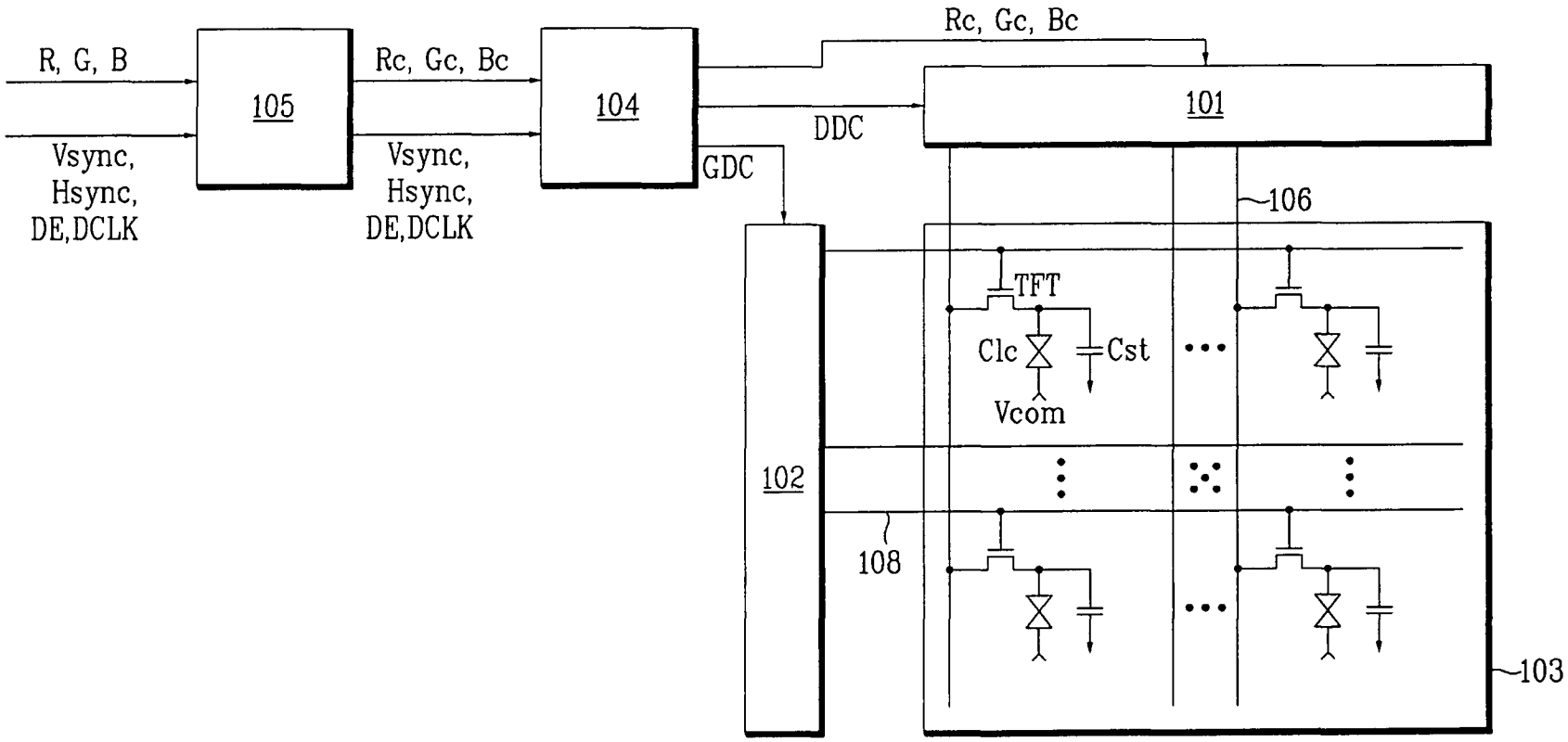
FIG. 1 is a block diagram illustrating a liquid crystal display (LCD) device according to embodiments of the invention.

FIG. 1 is a liquid crystal display (LCD) device capable of compensating for display defects in accordance with exemplary embodiments of the invention. The LCD device shown in FIG. 1 includes a data compensation circuit 105 and a timing controller 104. The LCD device also includes a data driver 101 and a gate driver 102, which function to drive a liquid crystal panel 103. The data compensation circuit can be implemented in the form of one semiconductor chip, together with the timing controller 104.

The data compensation circuit 105 receives data Re, Ge, and Be input from the outside of the LCD device, and receives a plurality of synchronizing signals Vsync, Hsync, DE, and DCLK. The data compensation circuit 105 stores, in a memory thereof, information for typical defect regions, such as regular horizontal lines or regular vertical lines, including position information, grayscale information, and compensation data for typical defect regions. The memory also stores information for point defect regions including position information, grayscale information, and compensation data for point defect regions. The data compensation circuit 105 compensates data to be displayed on a typical defect region, using information for the typical defect region, and outputs the compensated data. The data compensation circuit 105 executes the data compensation under the condition that the typical defect region is divided into a main region and boundary regions (first compensation). Thereafter, the data compensation circuit 105 finely compensates the data of the typical defect region, using the compensation data, under the condition that the compensation data for the typical defect region is spatially and temporally distributed in accordance with a frame rate control (FRC) dithering method (second compensation). The data compensation circuit 105 also compensates data of a point defect region, using information for the point defect region, and outputs the compensated data (third compensation). The data compensation circuit 105 then supplies the compensated data, namely, data Rc, Gc, and Bc, to the timing controller 104, together with the synchronizing signals Vsync, Hsync, DE, and DCLK. The data compensation circuit 105 also supplies, to the timing controller 104, data to be displayed on normal regions, without compensating the data. The detailed configuration of the data compensation circuit 105 will be described later.

The timing controller 104 arranges the data Rc, Gc, and Bc input from the data compensation circuit 105, and outputs the resultant data to the data driver 101. Using the synchronizing signals Vsync, Hsync, DE, and DCLK, the timing controller 104 generates a data control signal DDC to control the driving timing of the data driver 101 and a gate control signal GDC to control the driving timing of the gate driver 102. The timing controller 104 then outputs the data control signal DDC and gate control signal GDC.

In response to the data control signal DDC from the timing controller 104, the data driver 101 converts digital data received from the timing controller 104, namely, the data Rc, Gc, and Bc, to analog data, using gamma voltages. The data driver 101 outputs the analog data to data lines of the liquid crystal panel 103. In response to the gate control signal GDC from the timing controller 104, the gate driver 102 sequentially drives gate lines of the liquid crystal panel 103.

The liquid crystal panel 103 displays an image through a pixel matrix on which a plurality of pixels is arranged. Each pixel renders a desired color, using a combination of red, green, and blue sub-pixels adjusting a light transmittance through a variation in the alignment of liquid crystals according to a data signal. Each sub-pixel includes a thin film transistor (TFT) coupled to one gate line 17 and one data line 16. Each sub-pixel also includes a liquid crystal capacitor Clc and a storage capacitor Cst coupled to the TFT in parallel. The liquid crystal capacitor Clc is charged with a differential voltage between the data signal supplied to a pixel electrode via the TFT and a common voltage Vcom supplied to a common electrode, to drive liquid crystals in accordance with the charged voltage, and thus to adjust the light transmittance of the sub-pixel. Horizontal or vertical-line-shaped typical defect regions and point defect regions, which can be included in the liquid crystal panel 103 due to manufacture processes used, display data compensated by the data compensation circuit 105. As a result, a brightness difference between a normal regions and a defect region can be avoided, and thus enhancement of display quality is achieved.

Meanwhile, information for typical defect regions and information for point defect regions, which should be previously stored in the memory of the data compensation circuit 105, are set as follows.

Display defects can be divided into typical defects, which are regularly displayed in the form of horizontal lines or vertical lines, mainly due to a deviation in exposure light amount, and point defects, which are irregularly displayed typically due to an introduction of foreign matter. Such typical defects and point defects are detected in an inspection procedure for the video display device. Compensation data for the detected typical defects and compensation data for the detected point defects are then set. The set compensation data is stored in the memory of the data compensation circuit 105.

When a typical defect, which has the form of horizontal lines or vertical lines, is detected in a brightness inspection procedure for the video display device, the width of each divisional boundary area included in each boundary region and the position information for each boundary region according to the type of the detected typical defect and the stain distribution range of the typical defect region. Also, the stain degree of the typical defect region, namely, the brightness difference or color difference between the normal region and the defect region, is measured. Thereafter, compensation data to compensate for the measured brightness difference or color difference is set.

Figure 2:
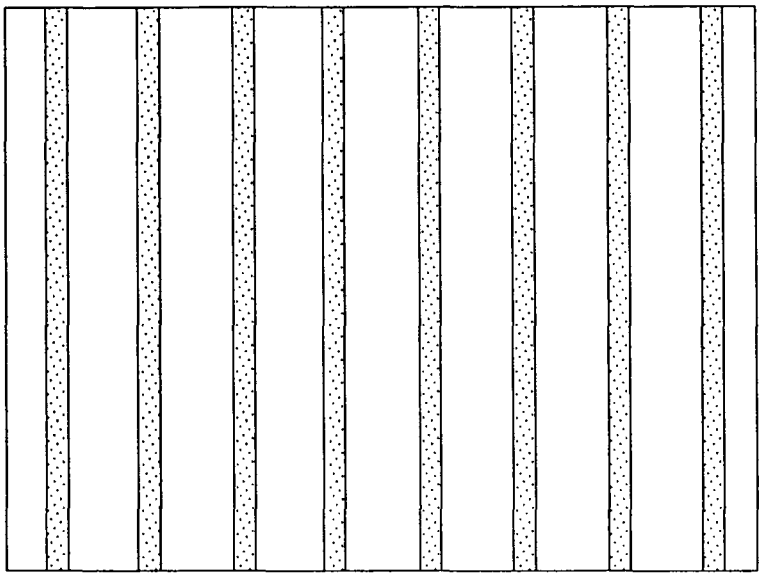
FIG. 2 is a view showing vertical line defect regions displayed on a liquid crystal panel.
Figure 3:
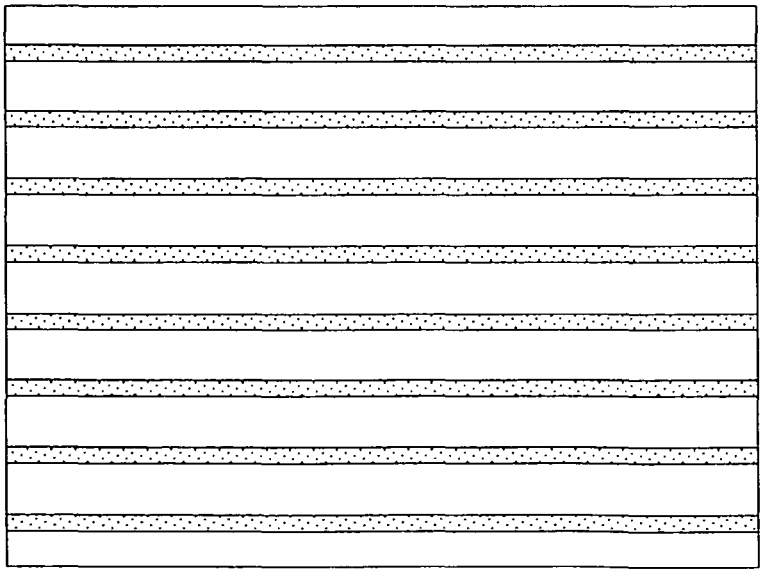
FIG. 3 is a view showing horizontal line defect regions displayed on a liquid crystal panel.
Figure 4:
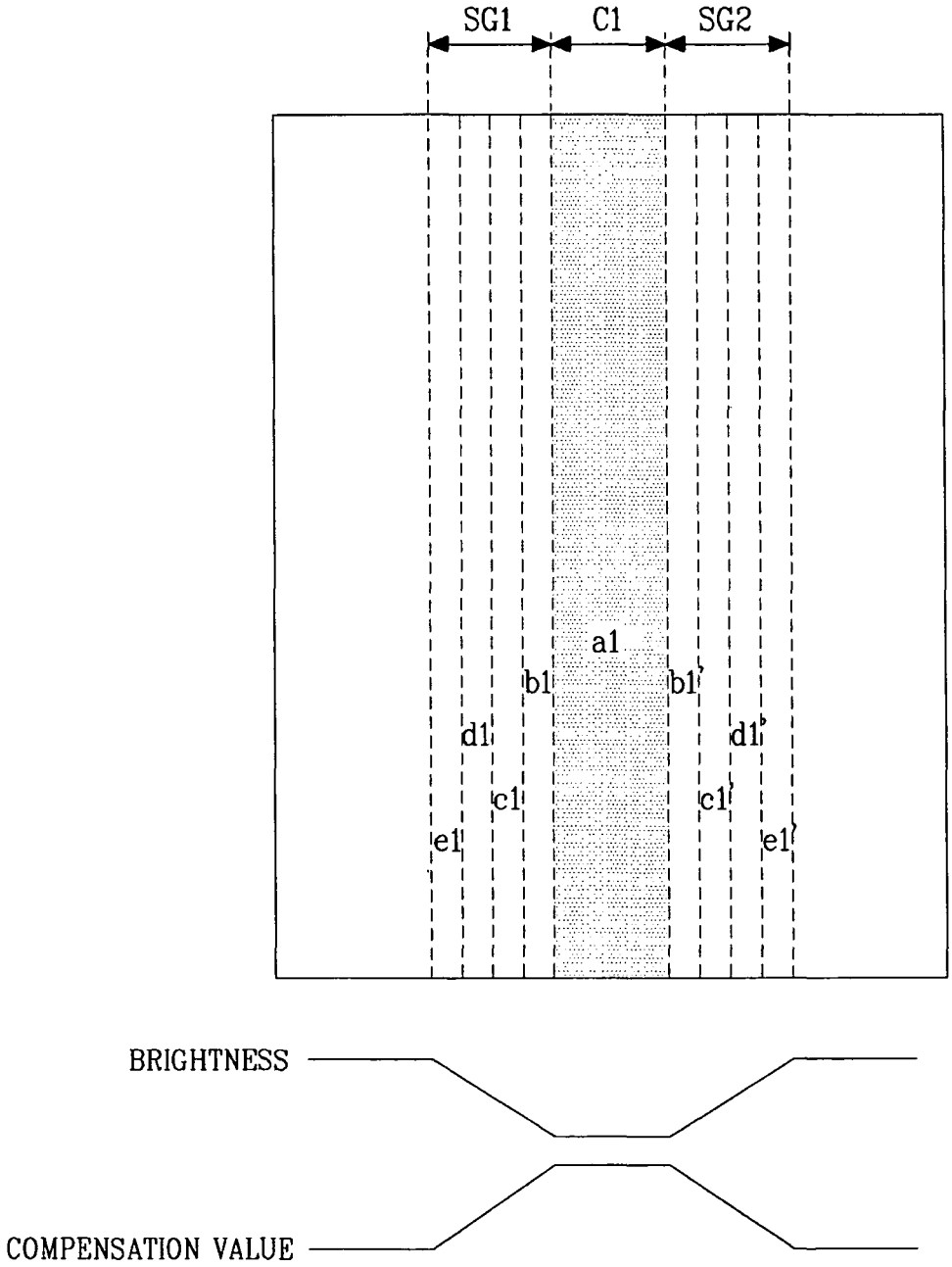
FIG. 4 is a schematic view illustrating, in an enlarged state, one vertical line defect region shown in FIG. 2.
Figure 5:
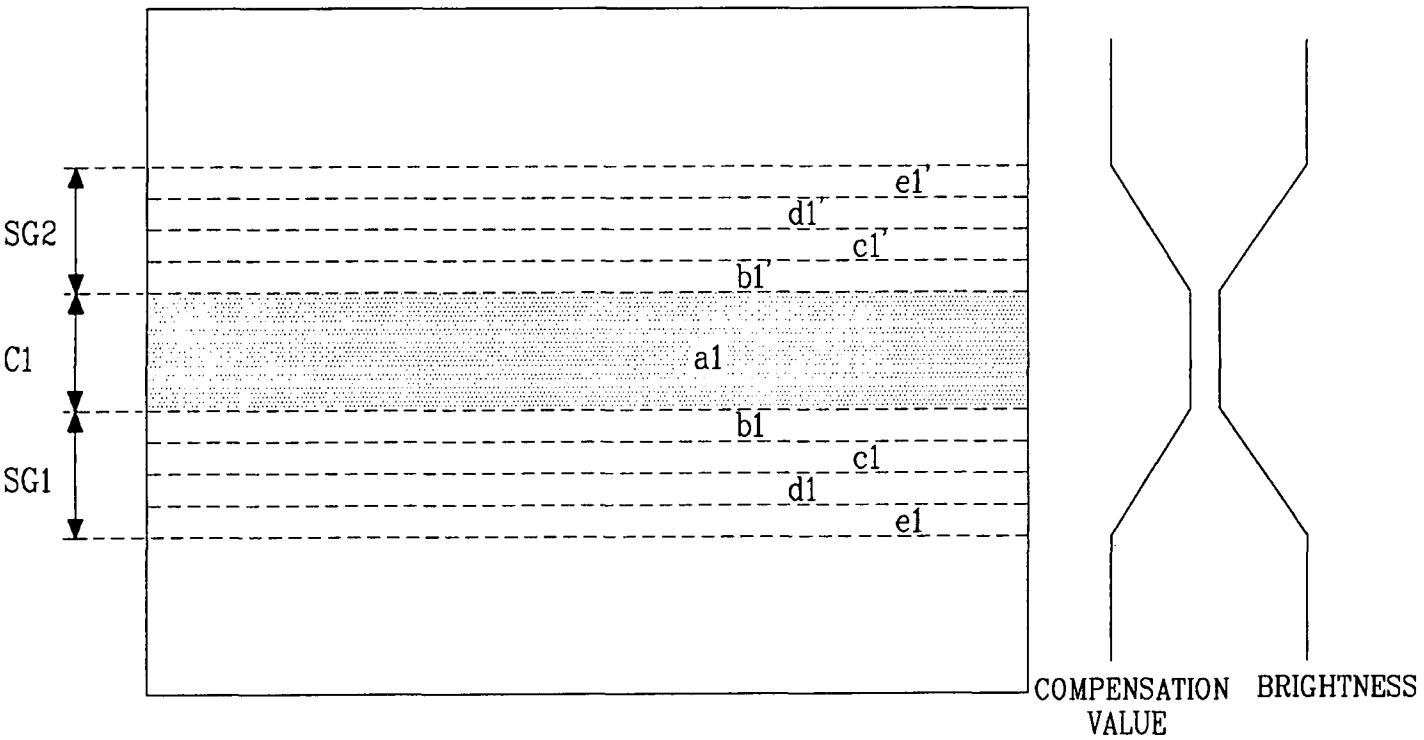
FIG. 5 is a schematic view illustrating, in an enlarged state, one horizontal line defect region shown in FIG. 3.

For example, in the inspection procedure, regular vertical line defect regions as shown in FIG. 2 or regular horizontal line defect regions as shown in FIG. 3 can be detected as typical defects of the display device. As shown in FIG. 4, each vertical line defect region can be divided into a main region C1 extending in a vertical direction while exhibiting a constant brightness, and boundary regions SG1 and SG2 symmetrically arranged at opposite sides of the main region C1 while exhibiting a gradually-varying brightness. As shown in FIG. 5, each horizontal line defect region can be divided into a main region C1 extending in a horizontal direction while exhibiting a constant brightness, and boundary regions SG1 and SG2 symmetrically arranged at opposite sides of the main region C1 while exhibiting a gradually-varying brightness. Each of the boundary regions SG1 and SG2 of each defect region corresponds to a region where the brightness of the main region C1 is overlapped with the brightness of a normal region arranged adjacent to the defect region. Each of the boundary regions SG1 and SG2 can be divided into a plurality of boundary areas such that the boundary areas of one boundary region SG1 or SG2 are symmetrical with the boundary areas of the other boundary region SG2 or SG1 with respect to the main region C1. Each of the boundary regions SG1 and SG2 displays a brightness gradually approaching the brightness of the main region C1 as it approaches the main region C1, while displaying a brightness gradually approaching the brightness of the normal region as it approaches the normal region.

The position information for the main region C1 is set in accordance with the start position of the main region C1 and the width of the main region C1. On the other hand, the position information for the boundary regions SG1 and SG2 are automatically set in accordance with the position information for the main region C1, the number of divisional boundary areas included in each of the boundary regions SG1 and SG2, and the width of each divisional boundary area. The number of divisional boundary areas included in each of the boundary regions SG1 and SG2, and the width of each divisional boundary area can be adjusted in accordance with the width of the main region C1 and the size of compensation data corresponding to the main region C1, within a range not deviating from the rule of a dither pattern to spatially and temporally distribute compensation data.

Figure 6:
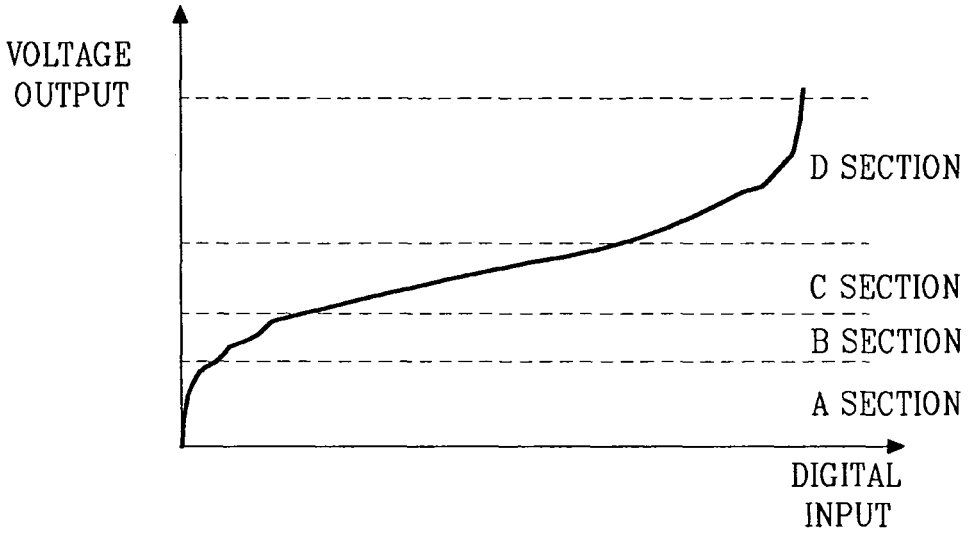
FIG. 6 is a graph depicting the gamma characteristics of an output voltage according to input data.

Compensation data a1 for the main region C1 of a typical defect region is set to compensate for the brightness difference between the main region C1 and the normal region. Compensation data for each of the symmetrically-arranged boundary regions SG1 and SG2, namely, compensation data pieces b1 to e1, are automatically set to be gradually reduced in the order of b1, c1, d1, and e1. Meanwhile, as shown in FIG. 6, the LCD device exhibits different gamma voltage characteristics in different grayscale ranges A, B, C, and D. Accordingly, each of the compensation data pieces a1 to e1 for the typical defect region is set to have different compensation values in accordance with different grayscale areas A, B, C, and D exhibiting different gamma characteristics. Also, the compensation data pieces a1 to e1 for the typical defect region can be set to have different compensation values in accordance with the position of the typical defect region.

Thus, the information for the typical defect detected in the inspection procedure, namely, the position information for the detected typical defect, the compensation data optimized for respective grayscale ranges in accordance with the position of the typical defect, and the grayscale range information representing the grayscale ranges, are stored in the memory.

In the inspection procedure, an operation to detect a point defect region is also executed. For the detected point defect region, position information and optimal compensation data are set. The set position information and compensation data are stored in the memory. That is, compensation data for the point defect region is optimized for each grayscale range in accordance with the display defect degree of the point defect region, using the same method as the above-described method used to optimize compensation data for vertical or horizontal line defect regions. The optimized compensation data is then stored in the memory. Grayscale information representing a grayscale range is also stored in the memory of the display device.

Figure 7:
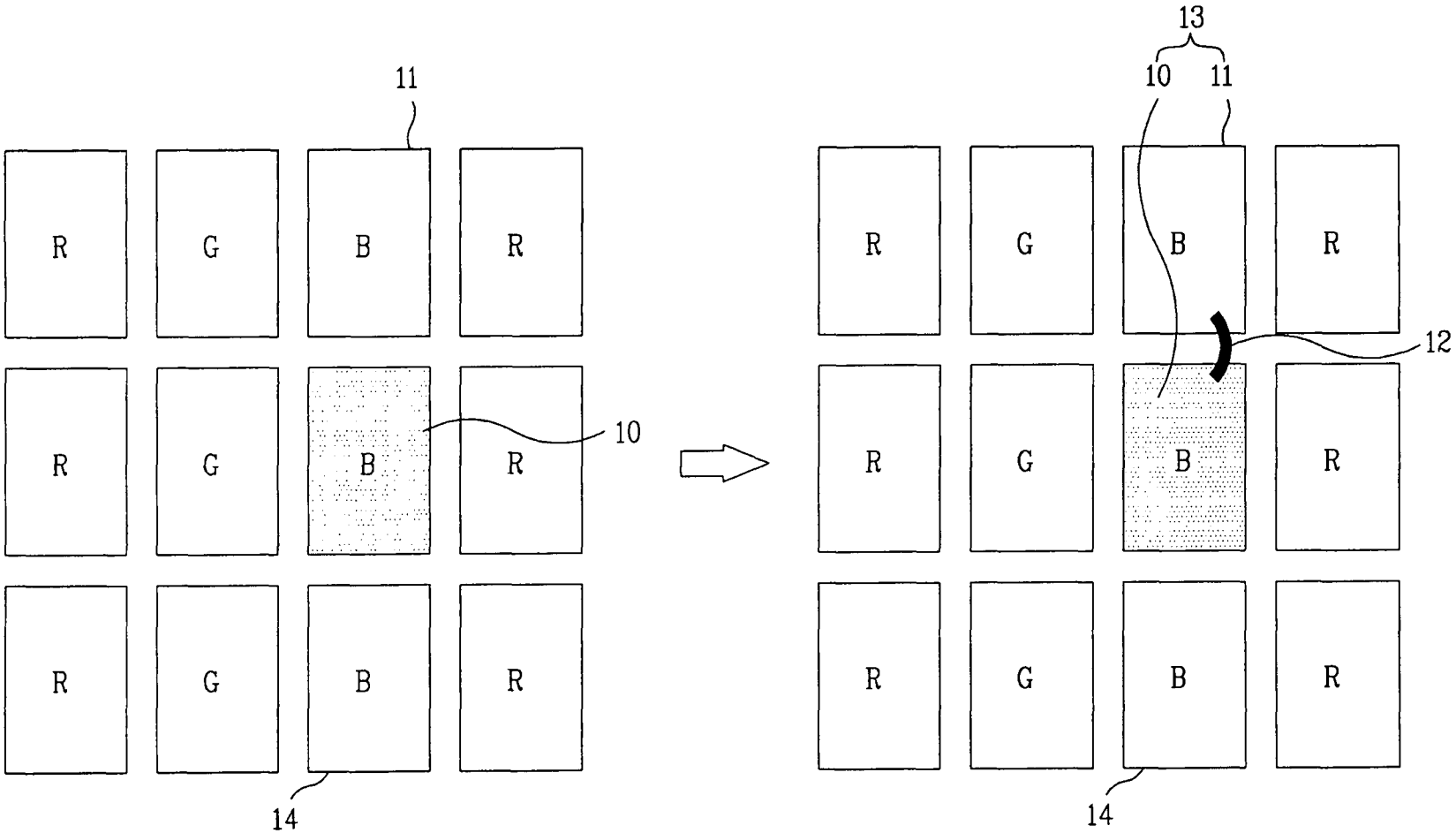
FIG. 7 is a schematic view illustrating a point defect region displayed on a liquid crystal panel.

For example, when a bright defect pixel having a defect caused by, for example, an introduction of foreign matter, is detected in the inspection procedure, a repair operation is executed by separating the bright defect pixel from the associated signal lines such that it becomes a dark pixel 10, and linking the dark pixel 10 to a normal pixel 11 neighboring to the dark pixel 10 via a link pattern 12, as shown in FIG. 7. In this case, a point defect can be displayed by a link pixel 13, which includes the linked normal pixel 11 and dark pixel 10. This is because data supplied to the normal pixel 11 must be distributed even to the dark pixel 10 linked to the normal pixel 11 to charge the normal pixel 11 so that the data charge amount for the normal pixel 11 is reduced, as compared to other normal pixels 14 not linked with other pixels. To compensate for point defects caused by such a data charge amount reduction, the brightness difference or color difference between the normal pixel and the linked pixel 13, namely, between the point defect region and the normal region, is measured. Thereafter, compensation data capable of compensating for the measured brightness difference or color difference is set. The compensation data for the point detect region is also optimized for respective grayscale ranges in accordance with the position of the point defect. The optimized compensation data is stored in the memory, together with the position information and grayscale range information for the point defect.

Figure 8:
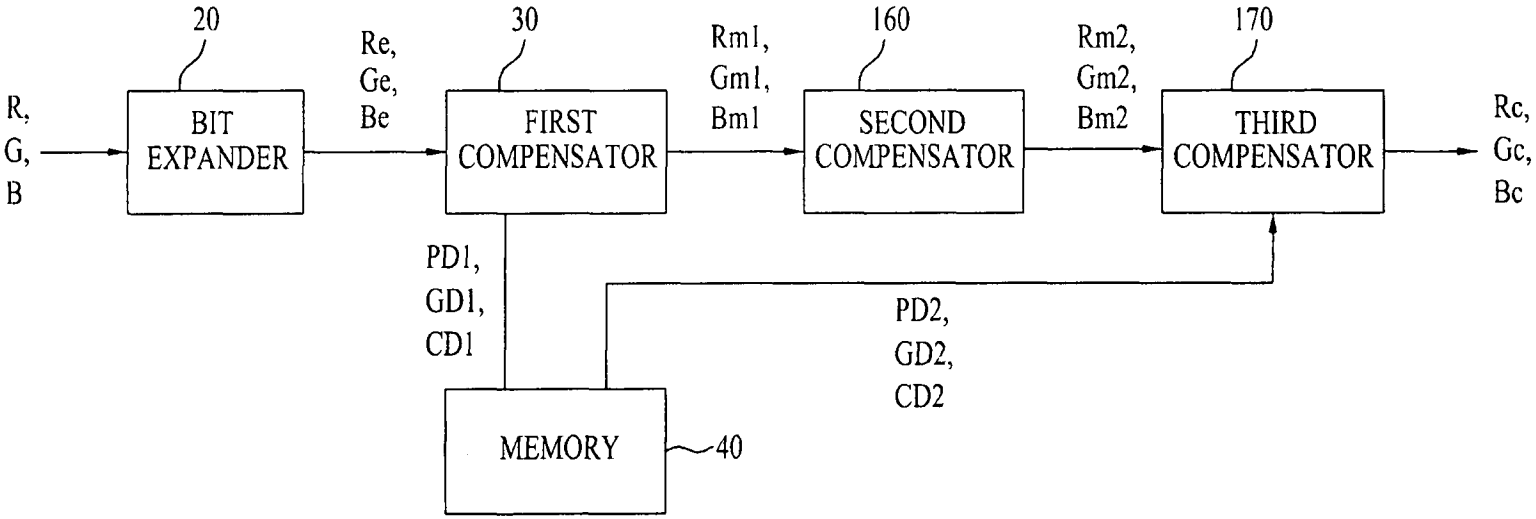
FIG. 8 is a block diagram illustrating a data compensation circuit according to a first embodiment of the invention.

FIG. 8 illustrates a data compensation circuit of the LCD device according to a first embodiment of the invention. As shown in FIG. 8, the data compensation circuit 105 includes a memory 40 storing typical defect information and point defect information, a first compensator 30 for compensating data Re, Ge, and Be of a typical defect region, using the typical defect information stored in the memory 40, and outputting data Rm1, Gm1, and Bm1 as compensated data, a second compensator 160 for finely compensating data Rm1, Gm1, and Bm1 output from the first compensator 30 by spatially and temporally distributing the data Rm1, Gm1, and Bm1, using an FRC dithering method, and a third compensator 170 for compensating data of a point defect region, using the point defect information stored in the memory 40. The third compensator 170 is coupled to the second compensator 160. For data of normal regions, the data compensation circuit 105 outputs the data without any data compensation.

As described above, the memory 40 stores typical defect information including position information PD1, grayscale range information GD1, and compensation data CD1 for typical defect regions having defects, such as vertical line defects and/or horizontal line defects. The position information PD1 for each typical defect region includes start position information and end position information for the defect region each represented by a corresponding number of pixels. For example, the position information PD1 of each typical defect region includes numbers of pixels respectively representing start position information and end position information for each of the main region included in the typical defect region and the divisional areas of each boundary region included in the typical defect region. The compensation data CD1 is used to compensate for a bright difference or color difference of the defect region from the normal region. The compensation data CD1 is stored after being sorted in accordance with the corresponding grayscale range and the position of the corresponding defect region. The compensation data CD1 for each typical defect region includes compensation values respectively optimized for the main region of the typical defect region and the divisional areas of each boundary region of the typical defect region. The grayscale range information GD1 includes information for a plurality of grayscale ranges divided in accordance with gamma characteristics. The memory 40 also stores point defect information including position information PD2, grayscale range information GD2, and compensation data CD2 for point defect regions.

The data compensation circuit 105 further includes a bit expander 20 for bit-expanding input data R, G, and B received from the outside of the LCD device, and supplying the bit-expanded data to the first compensator 30. For example, the bit expander 20 adds 3 bits ("000") to 8-bit input data as lower-order bits, to bit-expand the input data to 11-bit data. The bit expander 20 supplies the 11-bit data, namely, the data Re, Ge, and Be, to the first compensator 30.

The first compensator 30 compensates the input data Re, Ge, and Be, which will be displayed on a typical defect region having defects such as vertical line defects or horizontal line defects, using the typical defect information PD1, GD1, and CD1 stored in the memory 40, and outputs the compensated data. The first compensator 30 executes the data compensation by adding or subtracting, to or from the data of the typical defect region, compensation data PD1 corresponding to the data of the typical defect region. For data of normal regions, the first compensator 30 outputs the data without any data compensation.

The second compensator 160 finely compensates the compensated data Rm1, Gm1, and Bm1 output from the first compensator 30 by spatially and temporally distributing the data Rm1, Gm1, and Bm1, using an FRC dithering method. As the compensation data for each boundary region in the typical defect region is spatially and temporally distributed in accordance with the FRC dithering method, the brightness difference of the boundary region is finely compensated. For example, the second compensator 160 spatially and temporally distributes the compensation-data-applied lower-order bit portion of the data Rm1, Gm1, and Bm1 output from the first compensator 30, using a dither pattern. As a result, the brightness difference betveen the boundary region between the typical defect region and the normal region can be finely compensated.

The third compensator 170 compensates the data Rm2, Gm2, and Bm2, which will be displayed on a point defect region, using the point defect information PD2, GD2, and CD2 stored in the memory 40. For data of normal regions, the third compensator 170 outputs the data without any data compensation.

Figure 9:
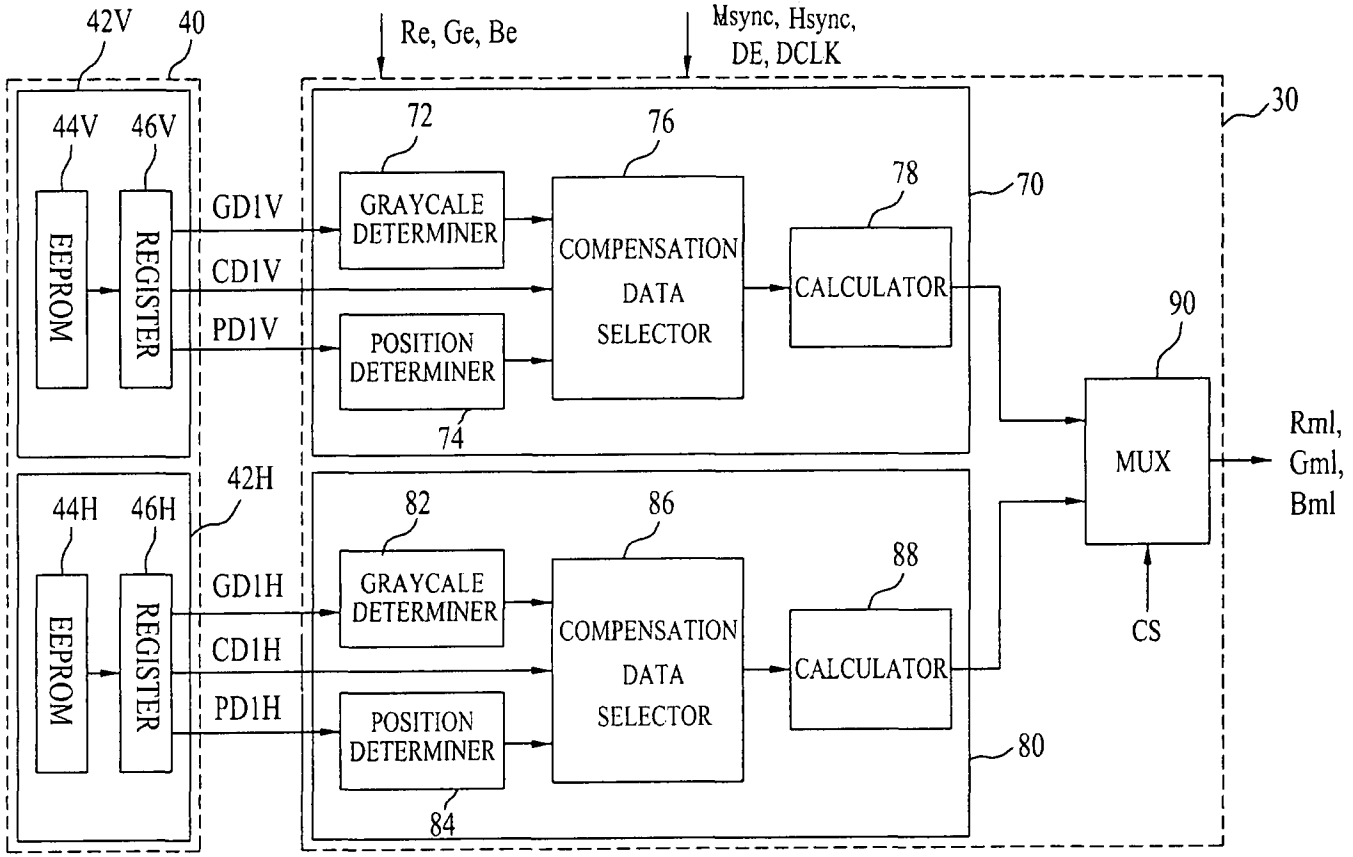
FIG. 9 is a block diagram illustrating memories and a first compensator shown in FIG. 8.

FIG. 9 illustrates the first compensator 30 and memory 40 shown in FIG. 8. As shown in FIG. 9, the first compensator 30 includes a vertical line compensator 70 and a horizontal line compensator 80 so that the first compensator 30 can be applied to both the display device having vertical line display defects and the display device having horizontal line display defects, irrespective of such kinds of display defects. The first compensator 30 also includes a multiplexer (MUX) 90 for selecting an output from the vertical line compensator 70 or an output from the horizontal line compensator 80 in accordance with whether the detected typical defect is a vertical line defect or a horizontal line defect.

The memory 40 includes a first memory 42V coupled to the vertical line compensator 70 while storing vertical line defect information, and a second memory 42H coupled to the horizontal line compensator 80 while storing horizontal line defect information. The first memory 42V includes an electrically-erasable programmable read only memory (EEPROM) 44V storing position information PD1V, grayscale range information GD1V, and compensation data CD1V for vertical line defect regions, and a register 46V for temporarily storing the data PD1V, GD1V, and CD1V stored in the EEPROM 44V, and supplying the temporarily-stored data to the vertical line compensator 70. The second memory 42H includes an EEPROM 44H storing position information PD1H, grayscale range information GD1H, and compensation data CD1H for horizontal line defect regions, and a register 46H for temporarily storing the data PD1H, GD1H, and CD1H stored in the EEPROM 44H, and supplying the temporarily-stored data to the horizontal line compensator 80. The two EEPROMs 44V and 44H can be implemented by a single EEPROM. Also, the two registers 46V and 46H can be implemented by a single register. In place of the EEPROMs 44V and 44H, an extended display identification data ROM (EDIDROM), which stores identification information, such as the resolution of the display device, can also be used. In this case, a portion of the EDIDROM can be appropriately allocated for the functions of the EEPROMs. One of the EEPROMs 44V and 44H can also store, at a specific address thereof, control information CS including typical defect direction information representing whether the defect type of a typical defect region is a vertical line defect or a horizontal line defect, typical defect compensation requirement/non-requirement information representing whether or not there is a typical defect region, and thus representing whether or not a compensation for a typical defect region is required, and point defect compensation requirement/non-requirement information representing whether or not a compensation for a point defect region is required. For example, respective bits of 3-bit data in one byte allocated for the control information CS can represent the three pieces of information. Meanwhile, the control information CS can be set by values of three option pins included in the timing controller 104, in which the data compensation circuit 105 is built.

To compensate the input data Re, Ge, and Be, which will be displayed on a vertical line defect region, the vertical line compensator 70 includes a grayscale determiner 72, a position determiner 74, a compensation data selector 76, and a calculator 78.

The grayscale determiner 72 analyzes respective grayscale levels of the input data Re, Ge, and Be, selects grayscale range information corresponding to the input data Re, Ge, and Be from among the grayscale range information GD1V read from the first memory 42V, based on the analyzed grayscale levels, and outputs the selected grayscale range information to the compensation data selector 76. For example, the grayscale range information GD1V can include three grayscale range information pieces respectively corresponding to three grayscale ranges divided from a 256 grayscale range in accordance with gamma characteristics, for example, a first grayscale range from 30 to 70, a second grayscale range from 71 to 150, and a third grayscale range from 151 to 250. The grayscale determiner 72 selects grayscale range information including the grayscale levels of the input data Re, Ge, and Be from among the three grayscale range information pieces, and outputs the selected grayscale range information.

The position determiner 74 determines a pixel position of the input data Re, Ge, and Be in a horizontal direction, using at least one of the vertical synchronizing signal Vsync, horizontal synchronizing signal Hsync, data enable signal DE, and dot clock DCLK. For example, the position determiner 74 determines the horizontal pixel position of the input data Re, Ge, and Be while counting pulses of the dot clock DCLK in an enable period of the data enable signal DE. The position determiner 74 then compares the determined horizontal pixel position of the input data Re, Ge, and Be with the vertical line defect region position information PD1V read from the first memory 42V, to detect whether or not the defect region is a vertical line defect region. When the defect region is detected as a vertical line defect region, the position determiner 74 selects the position information corresponding to the defect region from among the position information PD1V, and outputs the selected-position information to the compensation data selector 76.

The compensation data selector 76 selects compensation data corresponding to each of the input data Re, Ge, and Be from among the compensation data CD1V read from the first memory 42V in response to the grayscale range information selected by the grayscale determiner 72 and the position information selected by the position determiner 74. In other words, the compensation data selector 76 selects compensation data corresponding to the position information from the position determiner 74, from the corresponding grayscale range selected in accordance with the grayscale range information from the grayscale determiner 72, and outputs the selected compensation data. When the position information represents the main region of the vertical line defect region, the compensation data for compensating the main region is selected and output. On the other hand, when the position information represents the divisional areas of the boundary regions of the vertical line defect region, the compensation data for compensating the divisional areas is selected and output.

The calculator 78 compensates the input data Re, Ge, and Be, which will be displayed on the vertical line defect region, by adding or subtracting, to or from each of the input data Re, Ge, and Be, the associated compensation data output from the compensation data selector 76, and outputs the compensated data. For example, the calculator 78 compensates each of the input data Re, Ge, and Be by adding or subtracting the corresponding 8-bit compensation data output from the compensation data selector 76 to or from the 11-bit input data Re, Ge, or Be, and outputs the compensated data.

To compensate the input data Re, Ge, and Be, which will be displayed on a horizontal line defect region, the horizontal line compensator 80 includes a grayscale determiner 82, a position determiner 84, a compensation data selector 86, and a calculator 88.

The grayscale determiner 82 analyzes respective grayscale levels of the input data Re, Ge, and Be, selects grayscale range information corresponding to the input data Re, Ge, and Be from among the grayscale range information GD1H read from the second memory 42H, based on the analyzed grayscale levels, and outputs the selected grayscale range information to the compensation data selector 86.

The position determiner 84 determines a pixel position of the input data Re, Ge, and Be in a vertical direction, using at least one of the vertical synchronizing signal Vsync, horizontal synchronizing signal Hsync, data enable signal DE, and dot clock DCLK. For example, the position determiner 84 determines the vertical pixel position of the input data Re, Ge, and Be while counting pulses of the horizontal synchronizing signal Hsync in a period in which both the vertical synchronizing signal Vsync and the data enable signal DE are enabled. The position determiner 84 then compares the determined vertical pixel position of the input data Re, Ge, and Be with the horizontal line defect region position information PD1H read from the second memory 42H, to detect whether or not the defect region is a horizontal line defect region. When the defect region is detected as a horizontal line defect region, the position determiner 84 selects the position information corresponding to the defect region from among the position information PD1H, and outputs the selected position information to the compensation data selector 86.

The compensation data selector 86 selects compensation data corresponding to each of the input data Re, Ge, and Be from among the compensation data CD1H read from the second memory 42H in response to the grayscale range information selected by the grayscale determiner 82 and the position information selected by the position determiner 84. When the position information represents the main region of the horizontal line defect region, the compensation data for compensating the main region is selected and output. On the other hand, when the position information represents the divisional areas of the boundary regions of the horizontal line defect region, the compensation data for compensating the divisional areas is selected and output.

The calculator 88 compensates the input data Re, Ge, and Be, which will be displayed on the horizontal line defect region, by adding or subtracting, to or from each of the input data Re, Ge, and Be, the associated compensation data output from the compensation data selector 86, and outputs the compensated data.

The MUX 90 selects the output data from the vertical line compensator 70 or the output data from the horizontal line compensator 80 in response to the typical defect direction information included in the control information CS. That is, when the typical defect direction information represents a vertical line defect, the MUX 90 selectively outputs the output data from the vertical line compensator 70. On the other hand, when the typical defect direction information represents a horizontal line defect, the MUX 90 selectively outputs the output data from the horizontal line compensator 80.

Thus, the first compensator 30 compensates the input data Re, Ge, and Be of typical defect regions having defects, such as vertical line defects or horizontal line defects, in response to the control information CS, and outputs the compensated data.

Figure 10:
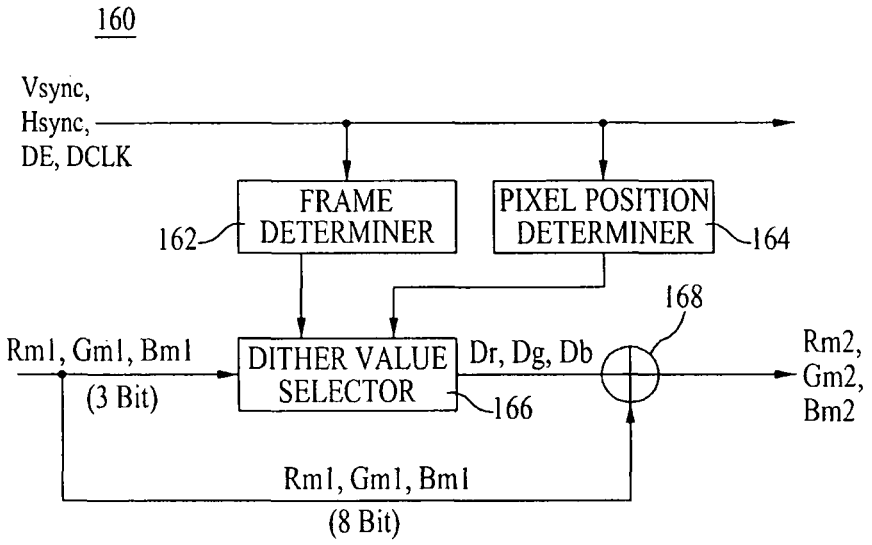
FIG. 10 is a block diagram illustrating a second compensator shown in FIG. 8.
Figure 11A:
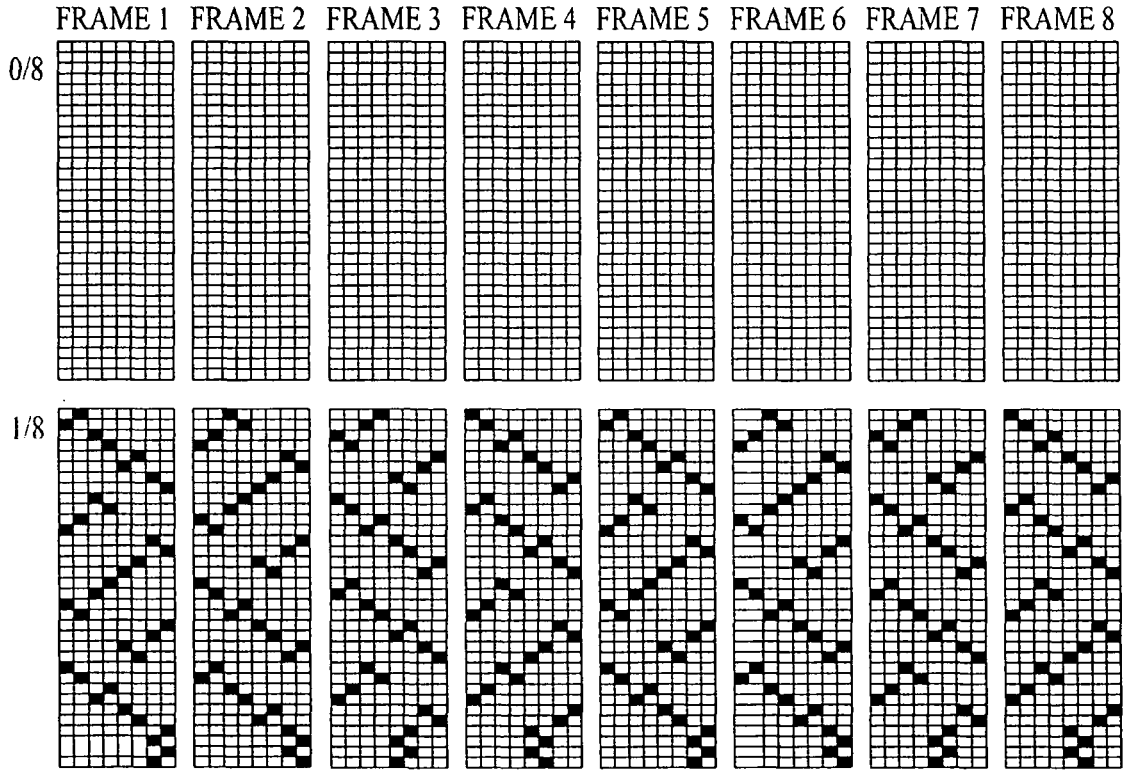
FIGS. 11A to 11D are views illustrating a plurality of dither patterns stored in a dither value selector shown in FIG. 10.
Figure 11B:
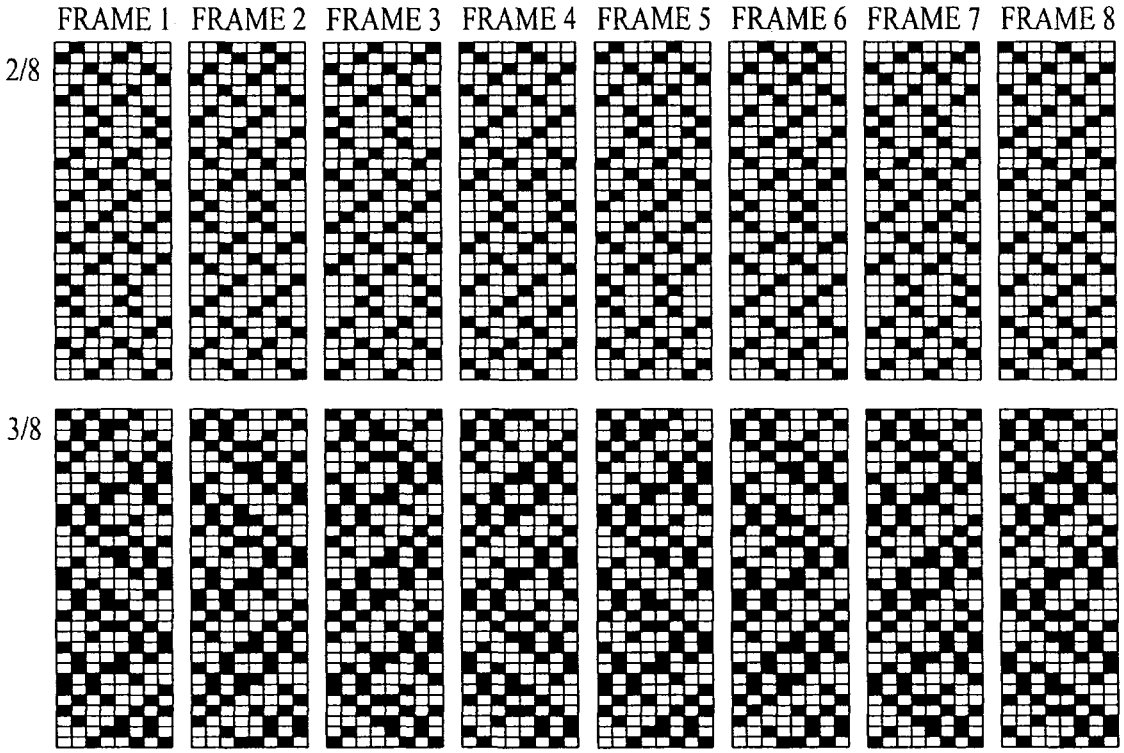
Figure 11C:
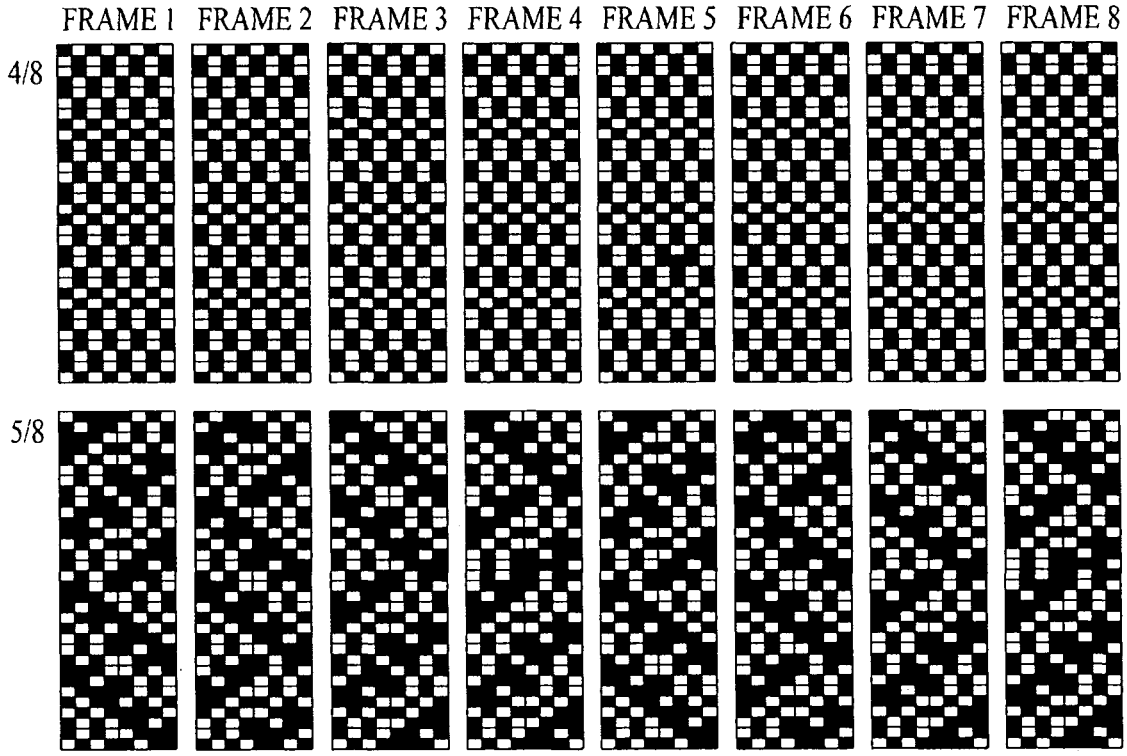
Figure 11D:
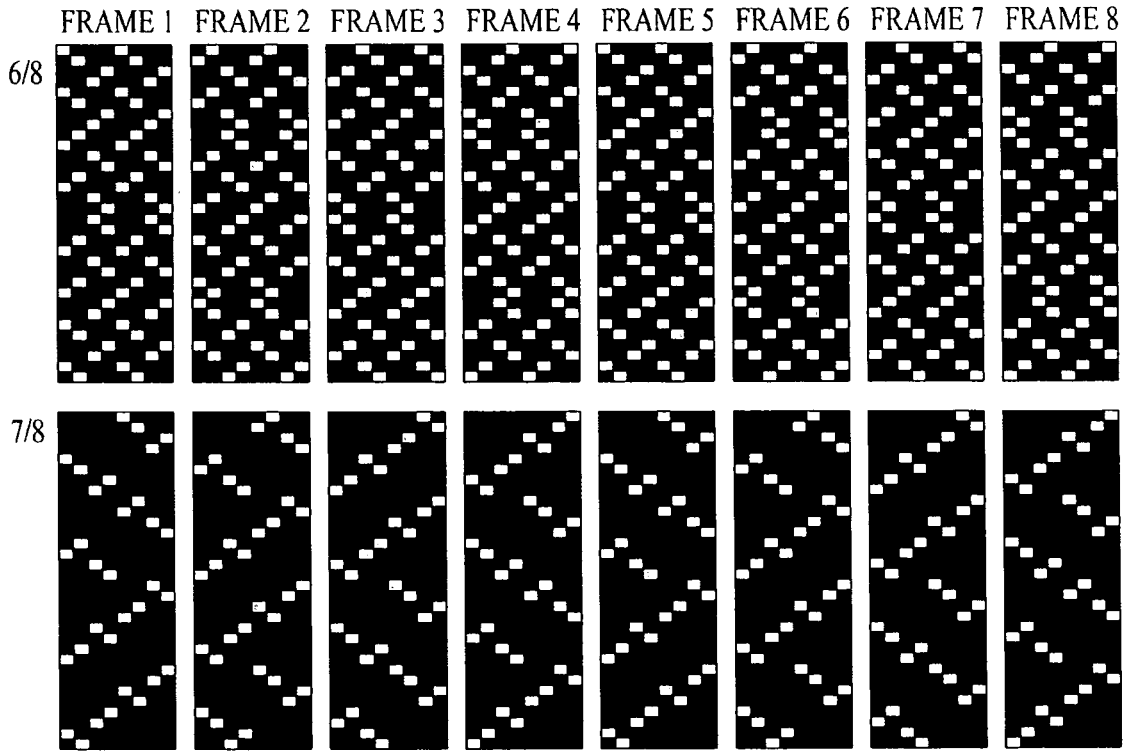

FIG. 10 illustrates the second compensator 160 shown in FIG. 8. As shown in FIG. 10, the second compensator 160 includes a frame determiner 162, a pixel position determiner 164, a dither value selector 166, and an adder 168.

The frame determiner 162 counts pulses of the vertical synchronizing signal Vsync selected from among a plurality of synchronizing signals supplied from the first compensator 30, namely, the synchronizing signals Vsync, Hsync, DE, and DCLK, to detect the number of frames. The frame determiner 162 outputs information representing the detected number of frames to the dither value selector 166.

The pixel position determiner 164 detects a pixel position of the input data Rm1, Gm1, and Bm1, using at least one of the synchronizing signals Vsync, Hsync, DE, and DCLK. For example, the position determiner 164 determines a horizontal pixel position of the input data Rm1, Gm1, and Bm1 while counting pulses of the dot clock DCLK in an enable period of the data enable signal DE, and determines a vertical pixel position of the input data Rm1, Gm1, and Bm1 while counting pulses of the horizontal synchronizing signal Hsync in a period in which both the vertical synchronizing signal Vsync and the data enable signal DE are enabled. The pixel position determiner 164 outputs information representing the detected pixel position to the dither value selector 166.

The dither value selector 166 selects desired dither values Dr, Dg, and Db from among a plurality of dither patterns, using the compensation data applied in the first compensator 30, namely, the grayscale levels corresponding to respective lower-order bits of the output data Rm1, Gm1, and Bm1 from the first compensator 30, the frame number information output from the frame determiner 162, and the pixel position information output from the pixel position determiner 164. The dither value selector 166 then outputs the selected dither values Dr, Dg, and Db.

The dither value selector 166 includes a plurality of dither patterns previously stored in the dither value selector 166 by a designer. For example, as shown in FIGS. 11A to 11D, the dither value selector 166 stores a plurality of dither patterns each having a 8×32 matrix size. The dither patterns are arranged to have gradually-increased numbers of pixels having a dither value of "1" (black) in accordance with grayscale levels of 0, ⅛, ⅜, ⅜, ⅝, ⅝, ⅞, ⅞, and 1, respectively (the dither pattern having a grayscale level of 1 is not shown). The dither patterns are stored in the form of a look-up table. Each pixel of each dither pattern has a dither value of "1" (black) or "0" (white). The grayscale level of each dither pattern is determined in accordance with the number of pixels having the dither value of "1". For each grayscale level, a plurality of dither patterns, which are different in terms of the positions of pixels having the dither value of "1" for different frames, are stored. Namely, a plurality of dither patterns respectively corresponding to a plurality of frames FRAME1 to FRAME8 different in terms of the positions of pixels having the dither value of "1" are stored. In other words, the dither value selector 166 stores a plurality of different dither patterns for each grayscale level and each frame. The size of the dither patterns and the positions of pixels having a dither value of "1" in each dither pattern can be varied in accordance with a designer's desire. Since the compensation data applied to the typical defect region in the first compensator 30 is spatially and temporally distributed, using the above-described dither patterns, it is possible to finely compensate for the brightness difference of the typical defect region.

Where each of the data Rm1, Gm1, and Bm1 output from the first compensator 30 consists of 11 bits, the dither value selector 166 selects a dither value, using the lower-order 3 bits of each 11-bit data, and outputs the remaining 8 bits to the adder 168. In this case, the 3-bit data is the data portion, to which the compensation data was applied in the first compensator 30. The 3-bit portion of data corresponding to a normal region is set to "000". The dither value selector 166 selects one dither pattern corresponding to the grayscale level represented by the lower-order 3 bits in each of the input data Rm1, Gm1, and Bm1 and the frame number information output from the frame determiner 162, from among the dither patterns as shown in FIGS. 11A to 11D. The dither value selector 166 then selects, from the selected dither pattern, 1-bit dither values Dr, Dg, and Db corresponding to respective pixel positions of the input data Rm1, Gm1, and Bm1, using the pixel position information from the pixel position determiner 164. The dither value selector 166 outputs the selected dither values Dr, Dg, and Db to the adder 168.

The adder 168 adds each of the dither values Dr, Dg, and Db selected by the dither value selector 166 to the upper-order 8 bits of the corresponding data Rm1, Gm1, or Bm1, from which the lower-order 3 bits were separated. The adder 168 then outputs the resultant data as data Rm2, Gm2, and Bm2.

Thus, the second compensator 160 spatially and temporally distributes the compensated data portions of the data Rm1, Gm1, and Bm1 output from the first compensator 30, using the FRC dithering method, to more finely compensate for the brightness difference of the typical defect region, and thus to prevent a degradation in display quality caused by compensation data.

Figure 12:
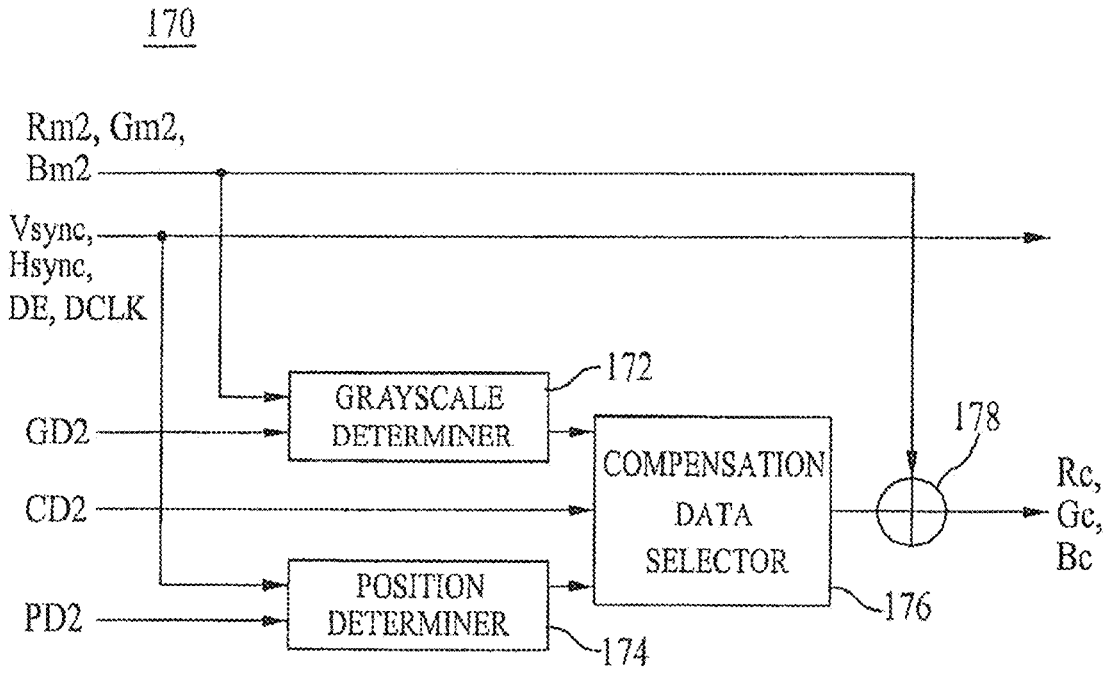
FIG. 12 is a block diagram illustrating a third compensator shown in FIG. 8.

FIG. 12 illustrates the third compensator 170 shown in FIG. 8. As shown in FIG. 12, the third compensator 170 includes a grayscale determiner 172, a position determiner 174, a compensation data selector 176, and a calculator 178. Each of the point defect information PD2, GD2, and CD2 used to compensate for point defect regions is stored in one of the first and second memories 42V and 42H.

The grayscale determiner 172 analyzes respective grayscale levels of the input data Rm2, Gm2, and Bm2 to be supplied to the link pixel of a point defect region, selects grayscale range information corresponding to the input data Rm2, Gm2, and Bm2 from among the grayscale range information GD2 read from one of the first and second memories 42V and 42H, based on the analyzed grayscale levels, and outputs the selected grayscale range information to the compensation data selector 176.

The position determiner 174 determines a pixel position of the input data Rm2, Gm2, and Bm2, using at least one of the vertical synchronizing signal Vsync, horizontal synchronizing signal Hsync, data enable signal DE, and dot clock DCLK input from an external system. For example, the position determiner 174 determines a horizontal pixel position of the input data Rm2, Gm2, and Bm2 while counting pulses of the dot clock DCLK in an enable period of the data enable signal DE, and determines a vertical pixel position of the input data Rm2, Gm2, and Bm2 while counting pulses of the horizontal synchronizing signal Hsync in a period in which both the vertical synchronizing signal Vsync and the data enable signal DE are enabled. The pixel position determiner 174 then compares the determined pixel position of the input data Rm2, Gm2, and Bm2 with the point defect region position information PD2 read from one of the first and second memories 42V and 42H, to detect whether or not the defect region is a point defect region. When the defect region is detected as a point defect region, the position determiner 174 outputs information representing the determined pixel position to the compensation data selector 176.

The compensation data selector 176 selects compensation data corresponding to each of the input data Rm2, Gm2, and Bm2 from among the compensation data CD2 read from one of the first and second memory 42V and 42H in response to the grayscale range information selected by the grayscale determiner 172 and the position information selected by the position determiner 174. The compensation data selector 176 then outputs the selected compensation data.

The calculator 178 adds or subtracts the compensation data output from the compensation data selector 176 to or from the input data Rm2, Gm2, and Bm2, and outputs the resultant data.

Thus, the third compensator 170 compensates the data Rm2, Gm2, and Bm2 of the point defect region, and outputs the compensated data.

As apparent from the above description, in the data compensation circuit according to the first embodiment of the invention, the brightness difference of a typical defect region is compensated by selecting one of the outputs from the vertical line compensator 70 and horizontal line compensator 80, which use separate memories 42V and 42H, respectively, in accordance with the associated typical defect direction information. In the data compensation circuit according to the first embodiment of the invention, the brightness difference of the boundary regions in the typical defect region is finely compensated by spatially and temporally distributing the compensation data applied to the data of the typical defect region in the first compensator 30 using the second compensator 160. Further, the brightness difference of a point defect region can also be compensated using the third compensator 170.

Figure 13:
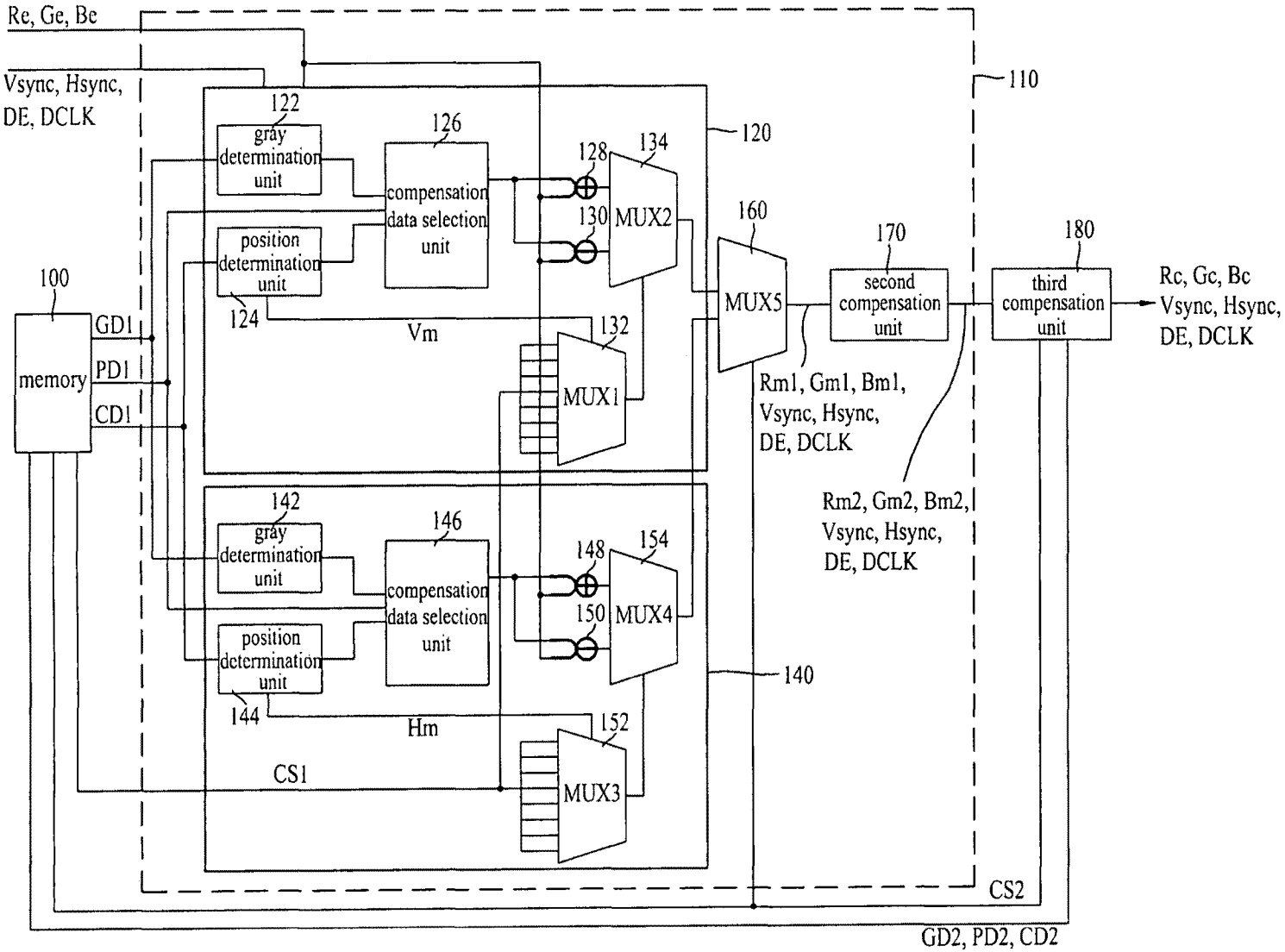
FIG. 13 is a block diagram illustrating a data compensation circuit according to a second embodiment of the invention.

FIG. 13 illustrates a data compensation circuit of the LCD device according to a second embodiment of the invention. As shown in FIG. 13, the data compensation circuit includes a memory 100 storing typical defect information PD1, CD1, and GD1 and point defect information PD2, CD2, and GD2, a first compensator 110 for compensating data Re, Ge, and Be of a typical defect region, using the typical defect information PD1, CD1, and GD1 stored in the memory 100, and outputting data Rm1, Gm1, and Bm1 as compensated data, a second compensator 160 for finely compensating data Rm1, Gm1, and Bm1 output from the first compensator 110 by spatially and temporally distributing the data Rm1, Gm1, and Bm1, using an FRC dithering method, and a third compensator 170 for compensating data of a point defect region, using the point defect information PD2, CD2, and GD2 stored in the memory 100. The third compensator 170 is coupled to the second compensator 160.

The first compensator 110 shown in FIG. 13 is different from the first compensator 30 shown in FIG. 9 in that the vertical line compensator 120 and horizontal line compensator 140 of the first compensator 110 share one memory 100 with each other.

Since display panels are divided into a type, in which vertical line defects may be generated, and a type, in which horizontal line defects may be generated, in accordance with the scanning direction of exposure equipment, the display device, which uses a display panel corresponding to one of the two types, uses only one of vertical line defect information and horizontal line defect information. Therefore, in accordance with the embodiments of the invention, parameters used in vertical line defect information and parameters used in horizontal line defect information are unified, and the vertical line defect information or horizontal line defect information is stored at the same address of the single memory 100 for both the vertical line defect information and the horizontal line defect information. Although the vertical line compensator 120 and horizontal line compensator 140 are parallel-driven after accessing the same address of the single memory 100, data compensated by the vertical line compensator 120 or data compensated by the horizontal line compensator 120 is output in accordance with whether the typical defect of the display device is a vertical line defect or a horizontal line defect. As a result, the data compensation circuit of embodiments of the invention can reduce the number of memories used, as compared to the case, in which the vertical line compensator 120 and horizontal line compensator 140 use separate memories, respectively. Although the single memory is used, it is possible to achieve a reduction in memory capacity, as compared to the case, in which vertical line defect information and horizontal line defect information are stored at different addresses, respectively.

The memory 100 includes an EEPROM storing the typical defect information PD1, CD1, and GD1, and the point defect information PD2, CD2, and GD2, and a register for temporarily storing the data stored in the EEPROM, and outputting the temporarily-stored data. Parameters used in vertical line defect regions and parameters used in horizontal line defect regions can be unified. Also, vertical line defect region information or horizontal line defect region information is stored at the same address of the memory 100 for both the vertical line defect region information and the horizontal line defect region information. For example, the position information PD1 for each of vertical line defect regions and horizontal line defect regions is represented by a corresponding number of pixels. Typical defect direction information for determining whether the typical defect of a defect region is a vertical line defect or a horizontal line defect is stored at a specific address of the memory 100. The typical defect direction information can also be represented, using the option pins of the timing controller, in which the data compensation circuit is built. For example, the typical defect direction information can be set to "0", to represent a vertical line defect, and can be set to "1", to represent a horizontal line defect. Where the typical defect direction information corresponds to "0", the position information PD1 stored in the memory 100 is set, using numbers of pixels allocated within a resolution range for horizontal lines, to represent positions of vertical line defect regions, respectively. On the other hand, where the typical defect direction information corresponds to "1", the position information PD1 stored in the memory 100 is set, using numbers of pixels allocated within a resolution range for vertical lines, to represent positions of horizontal line defect regions, respectively. In other words, the position information PD1 for typical defect regions represents positions of vertical line defect regions or positions of horizontal line defect regions, in accordance with the typical defect direction information set in the memory 100.

Figure 14:
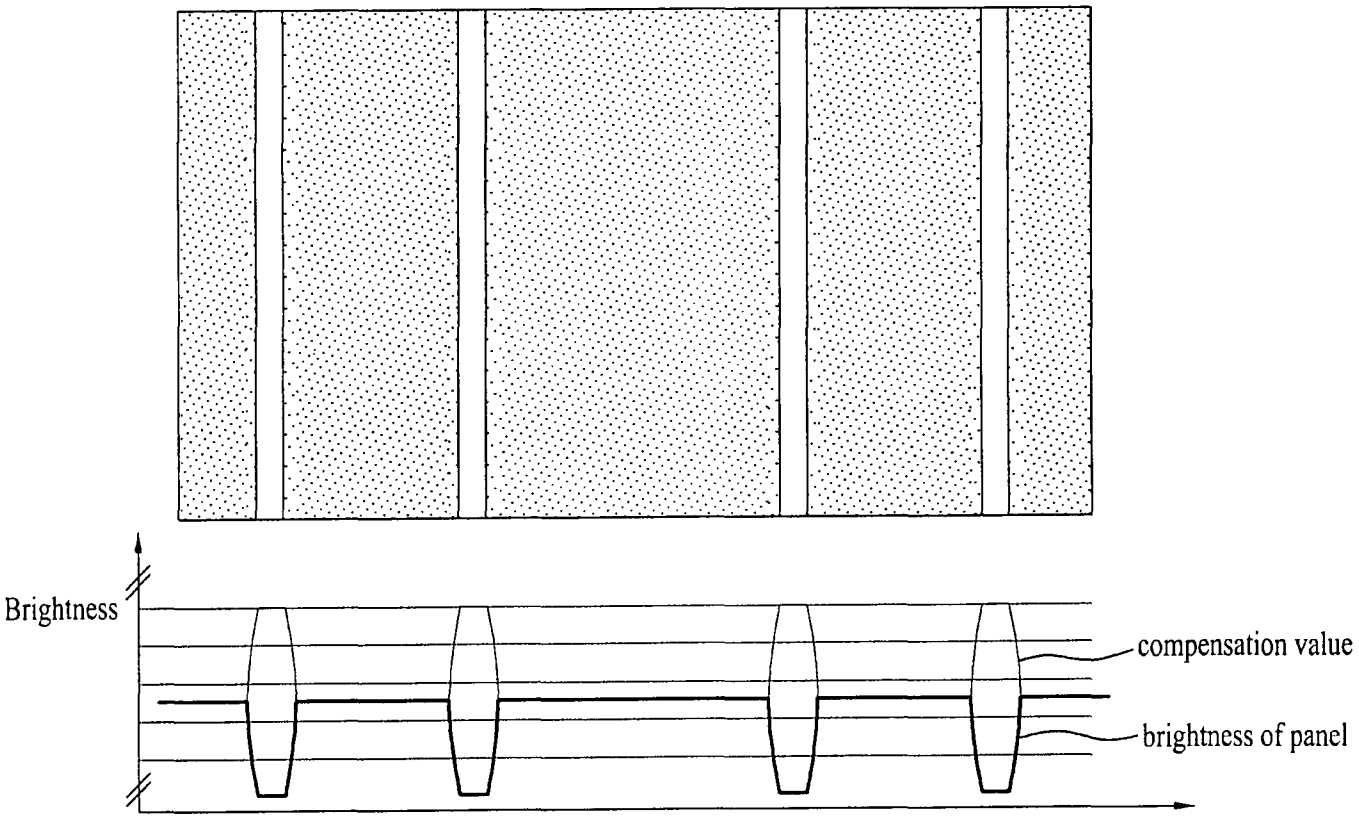
FIG. 14 is a view illustrating a bright typical defect region displayed on a liquid crystal panel.
Figure 15:
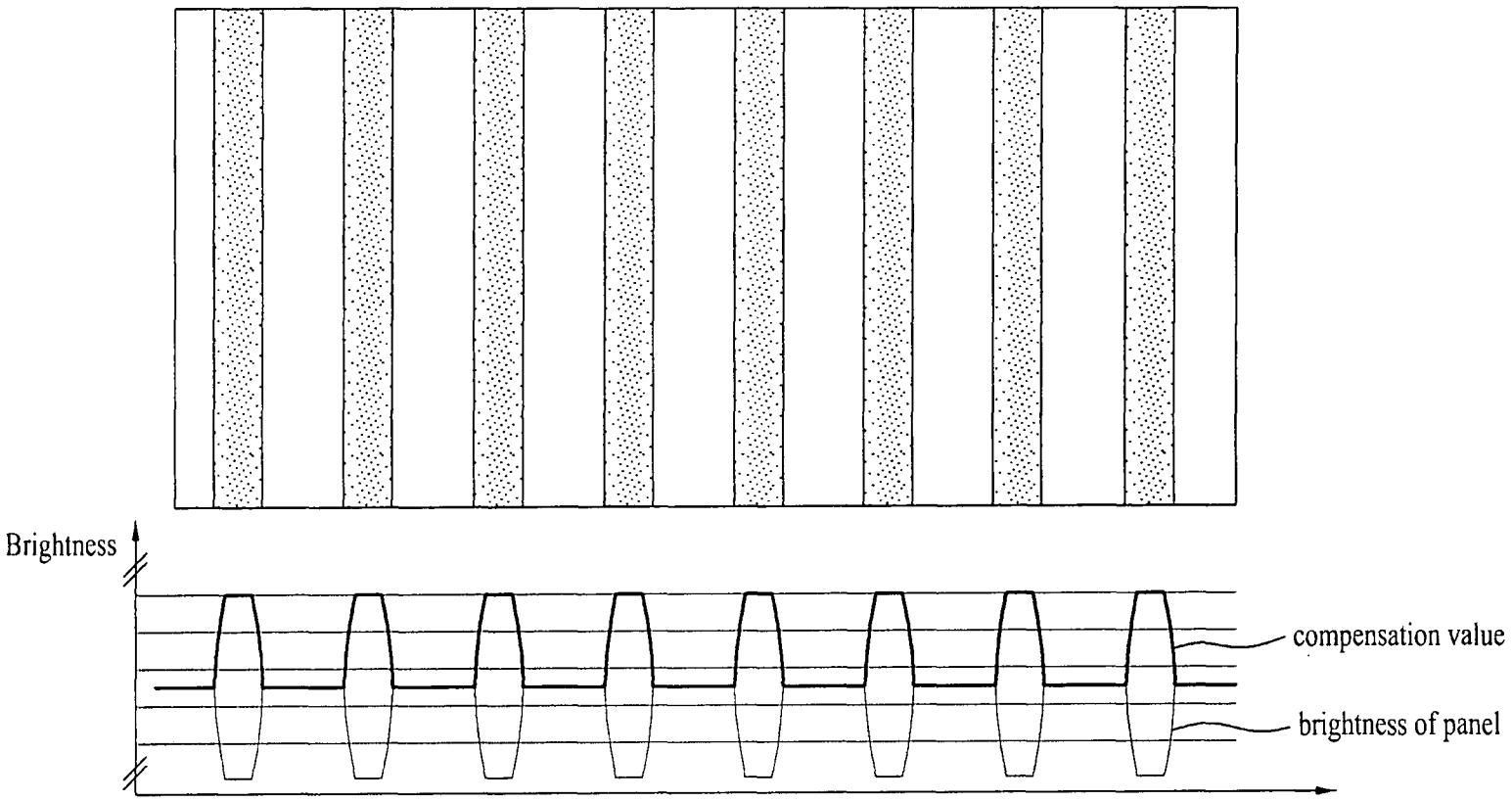
FIG. 15 is a view illustrating a dark typical defect region displayed on a liquid crystal panel.
Figure 16:
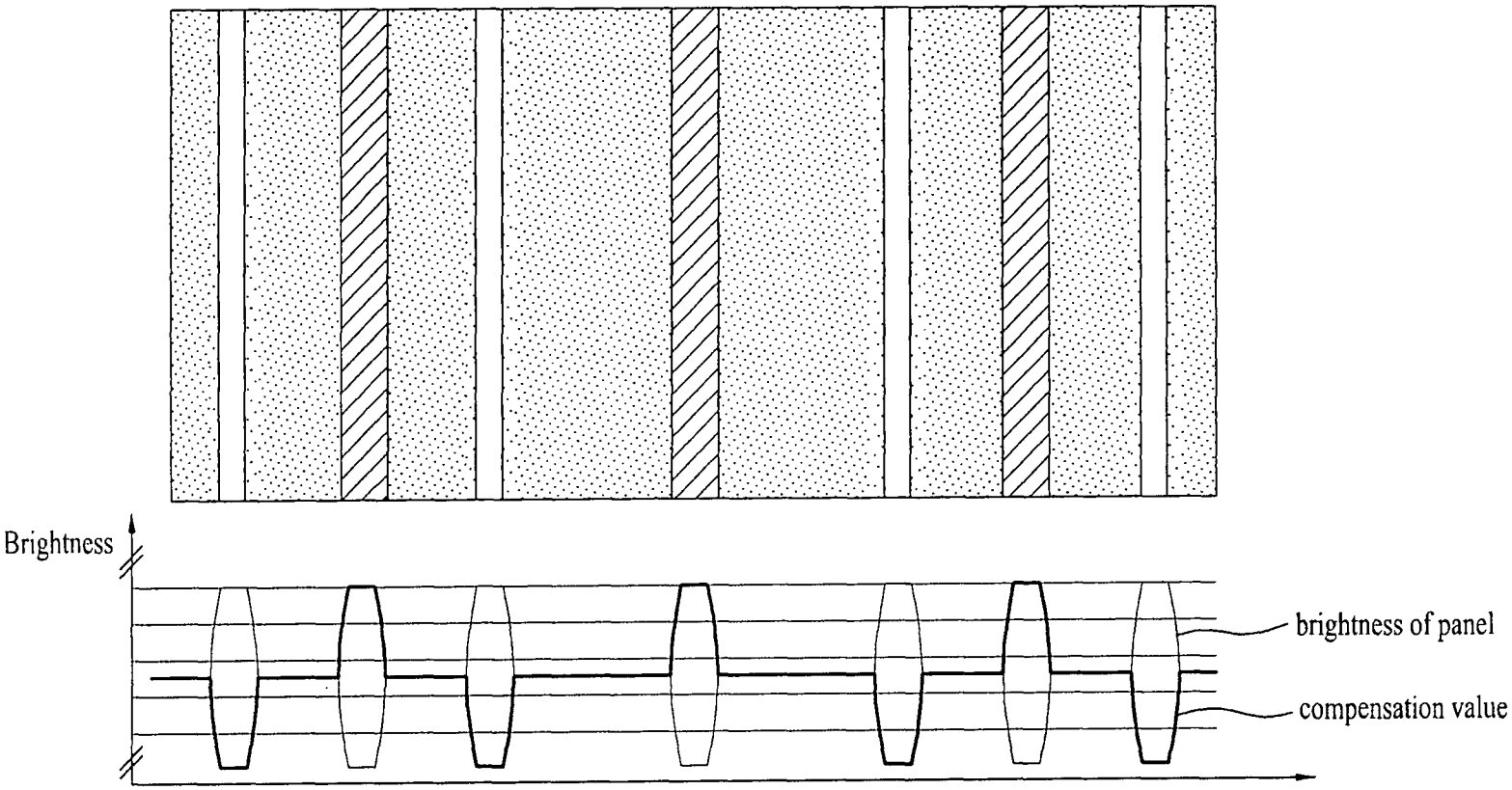
FIG. 16 is a view illustrating a state in which both bright defect regions and dark defect regions are displayed on a liquid crystal panel.

Meanwhile, typical defect regions can be displayed in a state of being brighter than normal regions, as shown in FIG. 14, in a state of being darker than the normal regions, as shown in FIG. 15, or in a state, in which both bright defect regions and dark defect regions are present as the typical defect regions, as shown in FIG. 16. The compensation data for a display defect is added (+) or subtracted (−) to or from the input data in accordance with whether the display defect corresponds to a bright defect region or a dark defect region, to compensate brightness. To this end, brightness information representing whether a typical defect region corresponds to a bright defect or a dark defect is stored in the memory 100 for typical defect regions, in accordance with the order of the typical defect regions. In other words, control information CS1 including brightness information for each typical defect region, together with information as to the order of the typical defect regions, is stored at a specific location in the memory 100, to sort the typical defect region into a defect region brighter than the normal region or a defect region darker than the normal region, as shown in FIGS. 14 to 16. For example, 3 bits of one byte allocated for the control information CS1 represents the information as to the order of the associated typical defect region, and 1 bit of the allocated byte represents brightness information representing whether the associated typical defect is a bright defect or a dark defect.

Also, typical defect direction information representing whether the defect type of a typical defect region is a vertical line defect or a horizontal line defect, typical defect compensation requirement/non-requirement information representing whether or not there is a typical defect region, and thus representing whether or not a compensation for a typical defect region is required, and point defect compensation requirement/non-requirement information representing whether or not a compensation for a point defect region is required can be stored at the same address, as control information CS2. For example, respective bits of 3-bit data in one byte allocated for the control information CS2 can represent the three pieces of information.

Meanwhile, the control information CS1 and CS2 can be set by values of option pins included in the timing controller 104, in which the data compensation circuit 105 is built.

Data Re, Ge, and Be bit-expanded by the bit expander 20 shown in FIG. 8 are input to the first compensator 110. The first compensator 110 compensates the input data Re, Ge, and Be, which will be displayed on a vertical line typical defect region or a horizontal line typical defect region, using the typical defect information PD1, GD1, and CD1 stored in the memory 100, and outputs the compensated data. In other words, the first compensator 110 compensates the input data Re, Ge, and Be of the main region C1 and boundary regions SG1 and SG2 included in the typical defect region, in response to the typical defect information PD1, CD1, and GD1 from the memory 100, and outputs the compensated data. For input data of normal regions, the first compensator 110 outputs the data without any data compensation.

In detail, the first compensator 110 includes a vertical line compensator 120 for compensating the input data Re, Ge, and Be, using the position information PD1 from the memory 100 as position information for a vertical line defect region, and outputting the compensated data, a horizontal line compensator 140 for compensating the input data Re, Ge, and Be, using the position information PD1 from the memory 100 as position information for a horizontal line defect region, and outputting the compensated data, and a MUX 160 for selecting the output data from the vertical line compensator 120 or the output data from the horizontal line compensator 140 in accordance with the typical defect direction information included in the control information CS2. The first compensator 110 parallel-drives the vertical line compensator 120 and horizontal line compensator 140, which share the memory 100 with each other, to simultaneously execute the vertical line compensation and horizontal line compensation for the input data Re, Ge, and Be. The first compensator 110 then selects the output data from the vertical line compensator 120 or the output data from the horizontal line compensator 140, through the MUX 160, and outputs the selected data.

The vertical line compensator 120 includes a grayscale determiner 122, a position determiner 124, a compensation data selector 126, an adder 128, a subtractor 130, and MUXs 132 and 134.

The grayscale determiner 122 analyzes respective grayscale levels of the input data Re, Ge, and Be, selects grayscale range information corresponding to the input data Re, Ge, and Be from among the grayscale range information GD1 read from the memory 100, based on the analyzed grayscale levels, and outputs the selected grayscale range information to the compensation data selector 126.

The position determiner 124 determines a pixel position of the input data Re, Ge, and Be in a horizontal direction, using at least one of the vertical synchronizing signal Vsync, horizontal synchronizing signal Hsync, data enable signal DE, and dot clock DCLK. For example, the position determiner 124 determines the horizontal pixel position of the input data Re, Ge, and Be while counting pulses of the dot clock DCLK in an enable period of the data enable signal DE. The position determiner 124 then compares the determined horizontal pixel position of the input data Re, Ge, and Be with the vertical line defect region position information PD1 read from the memory 100, to detect whether or not the defect region is a vertical line defect region. When the defect region is detected as a vertical line defect region, the position determiner 124 selects the position information corresponding to the defect region from among the position information PD1, and outputs the selected position information to the compensation data selector 126.

The compensation data selector 126 selects compensation data corresponding to each of the input data Re, Ge, and Be from among the compensation data CD1 read from the memory 100 in response to the grayscale range information selected by the grayscale determiner 122 and the position information selected by the position determiner 124. In other words, the compensation data selector 126 selects compensation data corresponding to the position information from the position determiner 124, from the corresponding grayscale range selected in accordance with the grayscale range information from the grayscale determiner 122, and outputs the selected compensation data. When the position information represents the main region of the vertical line defect region, the compensation data for compensating the main region is selected and output. On the other hand, when the position information represents the divisional areas of the boundary regions of the vertical line defect region, the compensation data for compensating the divisional areas is selected and output.

The adder 128 adds the compensation data output from the compensation data selector 126 to the input data Re, Ge, and Be, and outputs the resultant data. The subtractor 130 subtracts the compensation data output from the compensation data selector 126 from the input data Re, Ge, and Be, and outputs the resultant data.

The MUX 134 selects the output data from the adder 128 or the output data from the subtractor 130 in accordance with the brightness of the typical defect region, and outputs the selected data. The MUX 132 sequentially outputs the brightness information for typical defect regions in accordance with the order of the typical defect regions, to control the MUX 134, which selects the output from the adder 128 or the output from the subtractor 130. The typical defect region brightness information is stored in the memory 100, as the control information CS1, together with the typical defect region order information. The control information CS1 read from the memory 100 is repeatedly supplied to the MUX 132 in accordance with the number of the typical defect regions. The MUX 132 selects the control information CS1 corresponding to the order of a vertical line defect region detected by the position determiner 124, namely, a vertical line defect region order Vm, and supplies the selected control infonnation CS1 to the MUX 134. Accordingly, the MUX 134 selects the output from the adder 128 or the output from the subtractor 130 in accordance with the brightness information included in the control information CS1 supplied form the MUX 132, and supplies the selected output to the MUX 156.

The horizontal line compensator 140 includes a grayscale determiner 142, a position determiner 144, a compensation data selector 146, an adder 148, a subtractor 150, and MUXs 152 and 154. The horizontal line compensator 140 has the same circuit configuration as the vertical line compensator 120, except for the position determiner 144.

The grayscale determiner 142 analyzes respective grayscale levels of the input data Re, Ge, and Be, selects grayscale range information corresponding to the input data Re, Ge, and Be from among the grayscale range information GD1 read from the memory 100, based on the analyzed grayscale levels, and outputs the selected grayscale range information to the compensation data selector 146.

The position determiner 144 determines a pixel position of the input data Re, Ge, and Be in a vertical direction, using at least one of the vertical synchronizing signal Vsync, horizontal synchronizing signal Hsync, data enable signal DE, and dot clock DCLK. For example, the position determiner 144 determines the vertical pixel position of the input data Re, Ge, and Be while counting pulses of the horizontal synchronizing signal Hsync in a period in which both the vertical synchronizing signal Vsync and the data enable signal DE are enabled. The position determiner 144 then compares the determined vertical pixel position of the input data Re, Ge, and Be with the typical defect region position information PD1 read from the memory 100, to detect whether or not the defect region is a typical defect region. When the defect region is detected as a typical defect region, the position determiner 144 selects the position information corresponding to the defect region from among the position information PD1, and outputs the selected position information to the compensation data selector 146.

The compensation data selector 146 selects compensation data corresponding to each of the input data Re, Ge, and Be from among the compensation data CD1 read from the memory 100 in response to the grayscale range information selected by the grayscale determiner 142 and the position information selected by the position determiner 144.

The adder 148 adds the compensation data output from the compensation data selector 146 to the input data Re, Ge, and Be, and outputs the resultant data. The subtractor 150 subtracts the compensation data output from the compensation data selector 146 from the input data Re, Ge, and Be, and outputs the resultant data.

The MUX 154 selects the output data from the adder 148 or the output data from the subtractor 150 in accordance with the brightness information for the typical defect region included in the control information CS1, and outputs the selected data.

The MUX 152 selects the control information CS1 read from the memory 100 in accordance with the order of a typical defect region detected by the position determiner 144, namely, a typical defect region order Hm, and supplies to the selected control information CS1 to control the MUX 154. Accordingly, the MUX 154 can select the output from the adder 148 or the output from the subtractor 150 in accordance with the brightness information included in the control information CS1 supplied from the MUX 152. The MUX 154 then supplies the selected output to the MUX 156.

The MUX 156 selects the output data from the vertical line compensator 120 or the output data from the horizontal line compensator 140 in response to the typical defect direction information included in the control information CS2. That is, when the typical defect direction information represents a vertical line defect, the MUX 156 selectively outputs the output data from the vertical line compensator 120. On the other hand, when the typical defect direction information represents a horizontal line defect, the MUX 156 selectively outputs the output data from the horizontal line compensator 140.

Thus, the first compensator 110 compensates the input data Re, Ge, and Be of typical defect regions having defects such as vertical line defects or horizontal line defects, using the typical defect region information PD1, CD1, and GD1 stored in the single memory 100, and outputs the compensated data.

The second compensator 170 finely compensates compensated data Rm1, Gm1, and Bm1 output from the first compensator 110 by spatially and temporally distributing the data Rm1, Gm1, and Bm1, using an FRC dithering method. As the compensation data for the boundary regions of each typical defect region is spatially and temporally distributed in accordance with the FRC dithering method, the brightness difference of each boundary region is finely compensated.

The third compensator 180 compensates data Rm2, Gm2, and Bm2, which will be displayed on a point defect region, using the point defect information PD2, GD2, and CD2 stored in the memory 100. For data of normal regions, the third compensator 170 outputs the data without any data compensation.

As apparent from the above description, in the data compensation circuit according to the second embodiment of the invention, it is possible to compensate for the brightness difference of a typical defect region by selecting one of the outputs from the vertical line compensator 120 and horizontal line compensator 140, which share the single memory 100 with each other, in accordance with the associated typical defect direction information, while reducing the capacity of the memory 100. In the data compensation circuit according to the second embodiment of the invention, it is also possible to appropriately compensate for the brightness difference of the typical defect region by executing an addition or subtraction of the compensation data in accordance with whether the typical defect region is a bright defect region or a dark defect region.

Figure 17:
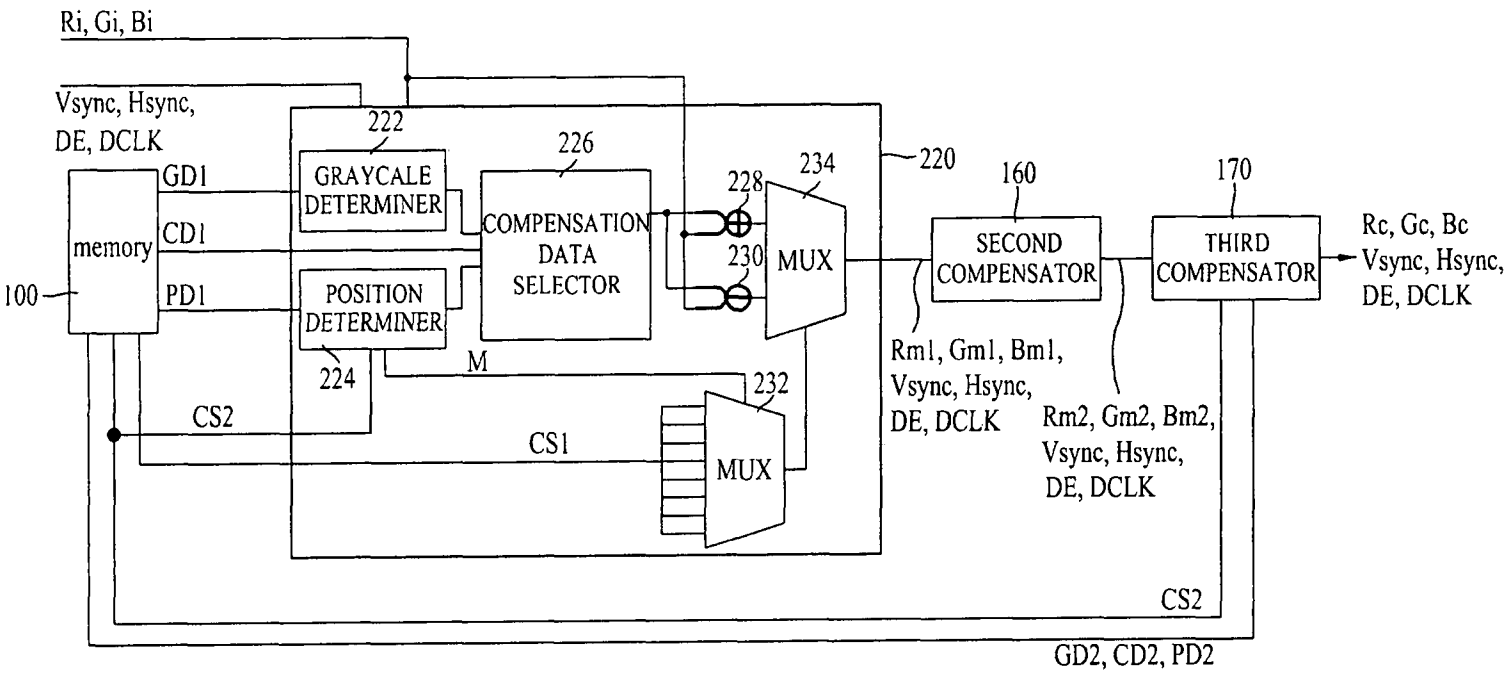
FIG. 17 is a block diagram illustrating a data compensation circuit according to a third embodiment of the invention.

FIG. 17 illustrates a data compensation circuit of the LCD device according to a third embodiment of the invention. As shown in FIG. 17, the data compensation circuit includes a memory 100 storing typical defect information PD1, CD1, and GD1 and point defect information PD2, CD2, and GD2, a first compensator 220 for compensating data Re, Ge, and Be of a typical defect region, using the typical defect information PD1, CD1, and GD1 stored in the memory 100, and outputting data Rm1, Gm1, and Bm1 as compensated data, a second compensator 160 for finely compensating data Rm1, Gm1, and Bm1 output from the first compensator 220 by spatially and temporally distributing the data Rm1, Gm1, and Bm1, using an FRC dithering method, and a third compensator 170 for compensating data of a point defect region, using the point defect information PD2, CD2, and GD2 stored in the memory 100. The third compensator 170 is coupled to the second compensator 160.

The first compensator 220 shown in FIG. 17 is different from the first compensator 110 shown in FIG. 13, in that the first compensator 220 has a single compensator configuration for executing data compensation irrespective of horizontal or vertical line defects.

The memory 100 includes an EEPROM storing the typical defect information PD1, CD1, and GD1, and the point defect information PD2, CD2, and GD2, and a register for temporarily storing the data stored in the EEPROM, and outputting the temporarily-stored data. Vertical line defect region information or horizontal line defect region information is stored at the same address of the memory 100 for both the vertical line defect region information and the horizontal line defect region information. Control information CS1 including brightness information for typical defect regions can also be stored in the memory 100, together with information as to the order of the typical defect regions. Also, typical defect direction information representing whether the defect type of a typical defect region is a vertical line defect or a horizontal line defect, typical defect compensation requirement/non-requirement information representing whether or not there is a typical defect region, and thus representing whether or not a compensation for a typical defect region is required, and point defect compensation requirement/non-requirement information representing whether or not a compensation for a point defect region is required can be stored in the memory 100, as control information CS2.

Data Re, Ge, and Be bit-expanded by the bit expander 20 shown in FIG. 8 are input to the first compensator 220. The first compensator 220 compensates the input data Re, Ge, and Be, which will be displayed on a vertical line typical defect region or a horizontal line typical defect region, using the typical defect information PD1, GD1, and CD1 stored in the memory 100, and outputs the compensated data. In other words, the first compensator 220 compensates the input data Re, Ge, and Be of the main region C1 and boundary regions SG1 and SG2 included in the typical defect region, in response to the typical defect information PD1, CD1, and GD1 from the memory 100, and outputs the compensated data. For input data of normal regions, the first compensator 220 outputs the data without any data compensation.

The first compensator 220 includes a grayscale determiner 222, a position determiner 224, a compensation data selector 226, an adder 228, a subtractor 230, and MUXs 232 and 234.

The grayscale determiner 222 analyzes respective grayscale levels of the input data Re, Ge, and Be, selects grayscale range information corresponding to the input data Re, Ge, and Be from among the grayscale range information GD1 read from the memory 100, based on the analyzed grayscale levels, and outputs the selected grayscale range information to the compensation data selector 226.

The position determiner 224 determines a pixel position of the input data Re, Ge, and Be in a horizontal direction or in a vertical direction, using at least one of the vertical synchronizing signal Vsync, horizontal synchronizing signal Hsync, data enable signal DE, and dot clock DCLK.

Figure 18:
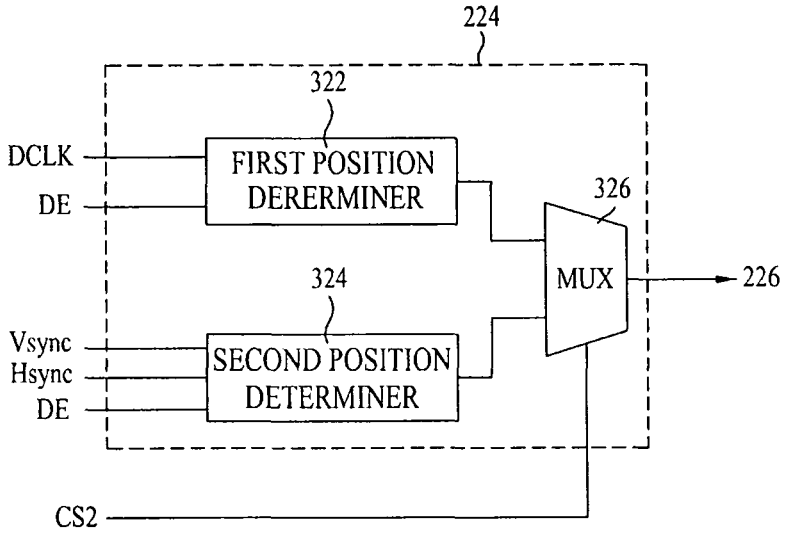
FIG. 18 is a block diagram illustrating a position determiner shown in FIG. 17.

In detail, as shown in FIG. 18, the position determiner 224 includes a first position determiner 322 for determining a pixel position of the input data Re, Ge, and Be in a horizontal direction, a second position determiner 324 for determining a pixel position of the input data Re, Ge, and Be in a vertical direction, and a MUX 326 for selecting an output from the first position determiner 322 or an output from the second position determiner 324 in accordance with the typical defect direction information included in the control information CS2.

The first position determiner 322 determines the horizontal pixel position of the input data Re, Ge, and Be while counting pulses of the dot clock DCLK in an enable period of the data enable signal DE. The first position determiner 322 then compares the determined horizontal pixel position of the input data Re, Ge, and Be with the typical defect region position information PD1 read from the memory 100, to detect whether or not the defect region is a typical defect region. When the defect region is detected as a typical defect region, the first position determiner 322 selects the position information corresponding to the defect region from among the position information PD1, and outputs the selected position information to the MUX 326.

The second position determiner 324 determines the vertical pixel position of the input data Re, Ge, and Be while counting pulses of the horizontal synchronizing signal Hsync in a period in which both the vertical synchronizing signal Vsync and the data enable signal DE are enabled. The second position determiner 324 then compares the determined vertical pixel position of the input data Re, Ge, and Be with the typical defect region position information PD1 read from the memory 100, to detect whether or not the defect region is a typical defect region. When the defect region is detected as a typical defect region, the second position determiner 324 selects the position information corresponding to the defect region from among the position information PD1, and outputs the selected position information to the MUX 326.

The MUX 326 supplies the typical defect region position information input from the first position determiner 322 or second position determiner 324 to the compensation data selector 226 in accordance with the typical defect direction information included in the control information CS2.

The compensation data selector 226 selects compensation data corresponding to each of the input data Re, Ge, and Be from among the compensation data CD1 read from the memory 100 in response to the grayscale range information selected by the grayscale determiner 222 and the position information selected by the position determiner 224.

The adder 228 adds the compensation data output from the compensation data selector 226 to the input data Re, Ge, and Be, and outputs the resultant data. The subtractor 230 subtracts the compensation data output from the compensation data selector 226 from the input data Re, Ge, and Be, and outputs the resultant data.

The MUX 234 selects the output data from the adder 228 or the output data from the subtractor 230 in accordance with the brightness of the typical defect region, and supplies the selected data to the second compensator 160.

The MUX 232 sequentially outputs the brightness information for typical defect regions in accordance with the order of the typical defect regions, to control the MUX 234, which selects the output from the adder 228 or the output from the subtractor 230. The typical defect region brightness information is stored in the memory 100, as the control information CS1, together with the typical defect region order information. The control information CS1 read from the memory 100 is repeatedly supplied to the MUX 232 in accordance with the number of the typical defect regions. The MUX 232 selects the control information CS1 corresponding to the order of a typical defect region detected by the position determiner 224, namely, a typical defect region order M, and supplies the selected control information CS1 to the MUX 234. Accordingly, the MUX 234 selects the output from the adder 228 or the output from the subtractor 230 in accordance with the brightness information included in the control information CS1 supplied form the MUX 232, and supplies the selected output to the second compensator 160.

Thus, the first compensator 220 compensates the input data Re, Ge, and Be of typical defect regions having defects such as vertical line defects or horizontal line defects, using the typical defect region information PD1, CD1, and GD1 stored in the single memory 100, and outputs the compensated data.

The second compensator 160 finely compensates compensated data Rm1, Gm1, and Bm1 output from the first compensator 220 by spatially and temporally distributing the data Rm1, Gm1, and Bm1, using an FRC dithering method. As the compensation data for the boundary regions of each typical defect region is spatially and temporally distributed in accordance with the FRC dithering method, the brightness difference of each boundary region is finely compensated.

The third compensator 170 compensates data Rm2, Gm2, and Bm2, which will be displayed on a point defect region, using the point defect information PD2, GD2, and CD2 stored in the memory 100. For data of normal regions, the third compensator 170 outputs the data without any data compensation.

As apparent from the above description, in the data compensation circuit according to the third embodiment of the invention, the first compensator 220, which has a single compensator configuration, compensates input data Re, Ge, and Be of typical defect regions having defects such as vertical line defects or horizontal line defects, using the typical defect region information PD1, CD1, and GD1 stored in the single memory 100, and outputs the compensated data. Accordingly, the data compensation circuit according to the third embodiment of the invention can reduce the capacity of the memory 100 while compensating data of various typical defect regions in accordance with the direction information for typical defect regions having defects such as vertical line defects or horizontal line defects. Since the first compensator 220 in the data compensation circuit according to embodiments of the invention has a unified compensator configuration without being divided into a vertical line compensator and a horizontal line compensator, it is possible to reduce the size of the associated logic circuit, and thus to reduce the manufacturing costs.

Meanwhile, the above-described data compensation circuit according to each embodiment of the invention can be applied not only to an LCD device, but also to other video display devices, such as OLED and PDP devices.

It will be apparent to those skilled in the art that various modifications and variations can be made in embodiments of the invention without departing from the spirit or scope of the inventions. Thus, it is intended that embodiments of the invention cover the modifications and variations of this invention provided they come within the scope of the appended claims and their equivalents.

What is claimed is:

1. A video display device capable of compensating for display defects identified as brightness aberrations on a liquid crystal display panel of the video display device, the display device comprising:

the liquid crystal display panel, wherein the liquid crystal display panel displays an image through a pixel matrix;

a data driver that drives data lines of the liquid crystal display panel;

a gate driver that drives gate lines of the liquid crystal display panel;

a memory that stores defect information on the display defects including a point defect of the display panel and at least one of a horizontal line defect of the display panel and a vertical line defect of the display panel, the horizontal line defect being a horizontal brightness aberration of the display panel, and the vertical line defect being a vertical brightness aberration of the display panel, the defect information including at least one of compensation data for the horizontal line defect and compensation data for the vertical line defect; and a data compensation circuit that receives input data and outputs compensated data and uncompensated data to a timing controller, wherein the data compensation circuit includes:

a vertical line compensator that compensates only for the vertical line defect of the display panel, the vertical line defect including first red, green, and blue pixels of the display panel, a horizontal line compensator that compensates only for the horizontal line defect of the display panel, the horizontal line defect including second red, green, and blue pixels of the display panel, and a multiplexer that selects and outputs an output from the vertical line compensator when compensating for the vertical line defect, or that selects and outputs an output from the horizontal line compensator when compensating for the horizontal line defect, wherein the vertical line compensator compensates for the vertical line defect by adding or subtracting the compensation data for the vertical line defect to first data among the input data to be displayed in a first region of the display panel having the vertical line defect, thereby producing the compensated data, the vertical line compensator output including the compensated data and the uncompensated data, the compensated data including data for the first red, green, and blue pixels of the display panel, wherein the horizontal line compensator compensates for the horizontal line defect by adding or subtracting the compensation data for the horizontal line defect to second data among the input data to be displayed in a second region of the display panel having the horizontal line defect, thereby producing the compensated data, the horizontal line compensator output including the compensated data and the uncompensated data, the compensated data including data for the second red, green, and blue pixels of the display panel, wherein the timing controller receives the compensated data, the uncompensated data, and synchronizing signals, outputs a gate control signal to the gate driver, and outputs a data control signal, the compensated data, and the uncompensated data to the data driver, wherein the data driver converts the compensated data and the uncompensated data received from the timing controller to analog data and drives the data lines of the display panel with the analog data, and wherein the data compensation circuit receives the input data and the synchronizing signals, and outputs the compensated data to the timing controller based on the defect information in the memory and the uncompensated data to the timing controller.

2. The video display device capable of compensating for the display defects according to claim 1, wherein the defect information also includes position information and grayscale information.

3. The video display device capable of compensating for the display defects according to claim 2, wherein the defect information also includes direction information.

4. The video display device capable of compensating for the display defects according to claim 2, wherein the defect information also includes order information and brightness information.

5. The video display device capable of compensating for the display defects according to claim 1, wherein the point defect refers to a pixel brightness aberration of the liquid crystal display panel, and the defect information includes position information, grayscale information and compensation data for the point defect.

6. The video display device capable of compensating for the display defects according to claim 5, wherein the horizontal line compensator and the vertical line compensator receive the input data and respectively compensate for the horizontal line defect and the vertical line defect each having a main region and boundary regions, the main region exhibiting a constant brightness and the boundary regions symmetrically arranged at opposite sides of the main region and exhibiting a varying brightness.

7. The video display device capable of compensating for the display defects according to claim 6, further comprising:

the horizontal line compensator and the vertical line compensator outputting a first compensated signal; and an additional compensator that receives the first compensated signal and further compensates the first compensated signal by spatially and temporally distributing the first compensated signal, and outputs the further compensated signal.

8. The video display device capable of compensating for the display defects according to claim 7, wherein the additional compensator includes:

a frame determiner for counting pulses of a vertical synchronizing signal among the synchronizing signals to detect a number of frames;

a pixel position determiner for determining and outputting pixel position information from the first compensated signal, the pixel position determiner counting pulses of at least one of the synchronizing signals to determine the pixel position information;

a dither value selector for selecting, from a plurality of dither patterns, a dither pattern that has been identified to correspond to a grayscale level for a particular frame number of the number of frames, then selecting, from the selected dither pattern, dither values that have been identified to correspond to the pixel position information output from the pixel position determiner; and an adder for adding the dither values from the dither value selector to the first compensated signal, thereby producing added data, the adder then outputting the added data.

9. The video display device capable of compensating for the display defects according to claim 7, further comprising a point defect compensator that receives the further compensated signal from the additional compensator, compensates for the point defect to produce point defect compensated data, and outputs the point defect compensated data.

10. The video display device capable of compensating for the display defects according to claim 9, wherein the point defect compensator includes:

a grayscale determiner that analyzes respective grayscale levels of the further compensated signal from the additional compensator to be supplied to a link pixel of the point defect, wherein the link pixel of the point defect includes a defective pixel of the point defect and a non-defective pixel neighboring the defective pixel, selects, from the memory, grayscale range information corresponding to the further compensated signal from the additional compensator to be supplied to the link pixel from the memory, and outputs the selected grayscale range information, wherein the pixel matrix includes the defective pixel and the non-defective pixel;

a position determiner that determines a pixel position from the further compensated signal from the additional compensator by counting pulses of at least one of input synchronizing signals, and outputs the pixel position;

a compensation data selector that selects the compensation data for the point defect stored in the memory for the selected grayscale range information and the pixel position; and a calculator that one of adds and subtracts the compensation data for the point defect to the further compensated signal from the additional compensator, thereby producing the point defect compensated data, and outputs the point defect compensated data.

11. A video display device capable of compensating for display defects identified as brightness aberrations on a liquid crystal display panel of the video display device, the display device comprising:

the liquid crystal display panel, wherein the liquid crystal display panel displays an image through a pixel matrix;

a data driver that drives data lines of the liquid crystal display panel;

a gate driver that drives gate lines of the liquid crystal display panel;

a memory that stores defect information on the display defects including a point defect of the display panel and at least one of a horizontal line defect of the display panel and a vertical line defect of the display panel, the horizontal line defect being a horizontal brightness aberration of the display panel, and the vertical line defect being a vertical brightness aberration of the display panel, the defect information including at least one of compensation data for the horizontal line defect and compensation data for the vertical line defect; and a data compensation circuit that receives input data and outputs compensated data and uncompensated data to a timing controller, wherein the data compensation circuit includes:

a vertical line compensator circuit that compensates only for the vertical line defect of the display panel, the vertical line defect including first red, green, and blue pixels of the display panel, a horizontal line compensator circuit that compensates only for the horizontal line defect of the display panel, the horizontal line defect including second red, green, and blue pixels of the display panel, and a multiplexer that selects and outputs an output from the vertical line compensator circuit when compensating for the vertical line defect, or that selects and outputs an output from the horizontal line compensator circuit when compensating for the horizontal line defect, wherein the vertical line compensator circuit compensates for the vertical line defect by adding or subtracting the compensation data for the vertical line defect to first data among the input data to be displayed in a first region of the display panel having the vertical line defect, thereby producing the compensated data, the vertical line compensator circuit output including the compensated data and the uncompensated data, the compensated data including data for the first red, green, and blue pixels of the display panel, wherein the horizontal line compensator circuit compensates for the horizontal line defect by adding or subtracting the compensation data for the horizontal line defect to second data among the input data to be displayed in a second region of the display panel having the horizontal line defect, thereby producing the compensated data, the horizontal line compensator circuit output including the compensated data and the uncompensated data, the compensated data including data for the second red, green, and blue pixels of the display panel, wherein the timing controller receives the compensated data, the uncompensated data, and synchronizing signals, outputs a gate control signal to the gate driver, and outputs a data control signal, the compensated data, and the uncompensated data to the data driver, wherein the data driver converts the compensated data and the uncompensated data received from the timing controller to analog data and drives the data lines of the display panel with the analog data, and wherein the data compensation circuit receives the input data and the synchronizing signals, and outputs the compensated data to the timing controller based on the defect information in the memory and the uncompensated data to the timing controller.

12. The video display device capable of compensating for the display defects according to claim 11, wherein the defect information also includes position information and grayscale information.

13. The video display device capable of compensating for the display defects according to claim 12, wherein the defect information also includes direction information.

14. The video display device capable of compensating for the display defects according to claim 12, wherein the defect information also includes order information and brightness information.

15. The video display device capable of compensating for the display defects according to claim 11, wherein the point defect refers to a pixel brightness aberration of the liquid crystal display panel, and the defect information includes position information, grayscale information and compensation data for the point defect.

16. The video display device capable of compensating for the display defects according to claim 15, wherein the horizontal line compensator circuit and the vertical line compensator circuit receive the input data and respectively compensate for the horizontal line defect and the vertical line defect each having a main region and boundary regions, the main region exhibiting a constant brightness and the boundary regions symmetrically arranged at opposite sides of the main region and exhibiting a varying brightness.

17. The video display device capable of compensating for the display defects according to claim 16, further comprising:

the horizontal line compensator circuit and the vertical line compensator circuit outputting a first compensated signal; and an additional compensator circuit that receives the first compensated signal and further compensates the first compensated signal by spatially and temporally distributing the first compensated signal, and outputs the further compensated signal.

18. The video display device capable of compensating for the display defects according to claim 17, wherein the additional compensator circuit includes:

a frame determiner circuit for counting pulses of a vertical synchronizing signal among the synchronizing signals to detect a number of frames;

a pixel position determiner circuit for determining and outputting pixel position information from the first compensated signal, the pixel position determiner circuit counting pulses of at least one of the synchronizing signals to determine the pixel position information;

a dither value selector circuit for selecting, from a plurality of dither patterns, a dither pattern that has been identified to correspond to a grayscale level for a particular frame number of the number of frames, then selecting, from the selected dither pattern, dither values that have been identified to correspond to the pixel position information output from the pixel position determiner circuit; and an adder circuit for adding the dither values from the dither value selector circuit to the first compensated signal, thereby producing added data, the adder circuit then outputting the added data.

19. The video display device capable of compensating for the display defects according to claim 17, further comprising a point defect compensator circuit that receives the further compensated signal from the additional compensator circuit, compensates for the point defect to produce point defect compensated data, and outputs the point defect compensated data.

20. The video display device capable of compensating for the display defects according to claim 19, wherein the point defect compensator circuit includes:

a grayscale determiner circuit that analyzes respective grayscale levels of the further compensated signal from the additional compensator circuit to be supplied to a link pixel of the point defect, wherein the link pixel of the point defect includes a defective pixel of the point defect and a non-defective pixel neighboring the defective pixel, selects, from the memory, grayscale range information corresponding to the further compensated signal from the additional compensator circuit to be supplied to the link pixel from the memory, and outputs the selected grayscale range information, wherein the pixel matrix includes the defective pixel and the non-defective pixel;

a position determiner circuit that determines a pixel position from the further compensated signal from the additional compensator circuit by counting pulses of at least one of input synchronizing signals, and outputs the pixel position;

a compensation data selector circuit that selects the compensation data for the point defect stored in the memory for the selected grayscale range information and the pixel position; and a calculator circuit that one of adds and subtracts the compensation data for the point defect to the further compensated signal from the additional compensator circuit, thereby producing the point defect compensated data, and outputs the point defect compensated data.

* * * * *